US011785996B2

(12) United States Patent
Bushby et al.

(10) Patent No.: US 11,785,996 B2
(45) Date of Patent: Oct. 17, 2023

(54) SLEEVED PARTIAL UNDERGARMENT AND GARMENT SYSTEM

(71) Applicant: SleeveIt LLC, Spring, TX (US)

(72) Inventors: Donald P. Bushby, Spring, TX (US); Josefina Perez Pacaon, Spring, TX (US)

(73) Assignee: Sleevelt LLC, Spring, TX (US)

( * ) Notice: Subject to any disclaimer, the term of this patent is extended or adjusted under 35 U.S.C. 154(b) by 585 days.

(21) Appl. No.: 16/707,982

(22) Filed: Dec. 9, 2019

(65) Prior Publication Data

US 2020/0113261 A1 Apr. 16, 2020
US 2023/0263250 A9 Aug. 24, 2023

Related U.S. Application Data

(63) Continuation of application No. 15/722,691, filed on Oct. 2, 2017, now Pat. No. 10,568,373, which is a continuation of application No. 15/053,791, filed on Feb. 25, 2016, now Pat. No. 9,801,419, which is a (Continued)

(51) Int. Cl.

| | |
|---|---|
| ***A41D 27/10*** | (2006.01) |
| ***A41B 9/06*** | (2006.01) |
| ***A41B 1/08*** | (2006.01) |

(52) U.S. Cl.
CPC ..... *A41D 27/10* (2013.01); *A41B 1/08* (2013.01); *A41B 9/06* (2013.01); *A41B 2400/44* (2013.01); *A41D 2200/20* (2013.01)

(58) Field of Classification Search
CPC ..... A41D 27/10; A41D 2200/20; A41B 1/08; A41B 9/06; A41B 2400/44
See application file for complete search history.

(56) References Cited

U.S. PATENT DOCUMENTS

| | | | |
|---|---|---|---|
| 1,117,077 | A | 11/1914 | Mooney |
| 1,167,058 | A | 1/1916 | Finberg |
| 1,285,917 | A | 11/1918 | Bradley et al. |

(Continued)

OTHER PUBLICATIONS zappos.com; Pearl Izumi W Fly Shrug (item information); 2 pages; retrieved Dec. 9, 2014 from the internet (http://www.zappos.com/pearl-izumi-w-fly-shrug-black?ef_id=VCDn6QAAALpN6F9s:20140923033204:s).

(Continued)

*Primary Examiner* — Katherine M Moran
(74) *Attorney, Agent, or Firm* — Brian F. Russell

(57) ABSTRACT

A unitary sleeved partial undershirt may be configured to be worn as an outer garment or beneath an outer garment. The partial undershirt may include tubular first and second sleeves of at least 12 inches in length, each having tubular construction that is void of any fastener. The first and second sleeves may be sized to conform to contours of arms of the wearer. The partial undershirt may additionally include a yoke including a front yoke portion, a back yoke portion, an undershirt neck edge defining an undershirt neck opening, and an undershirt torso opening edge defining an undershirt torso opening. The yoke may extend continuously and non-separably between the sleeves, and the front and/or back yoke portions may be sized such that the distance between the undershirt neck edge and the undershirt torso opening edge at the front yoke portion and back yoke portion is in a range between 1.35 and 8.8 inches.

46 Claims, 31 Drawing Sheets

Related U.S. Application Data continuation of application No. 14/530,158, filed on Oct. 31, 2014, now Pat. No. 9,314,058.

(60) Provisional application No. 62/070,477, filed on Aug. 25, 2014, provisional application No. 62/041,122, filed on Aug. 24, 2014.

(56) References Cited

U.S. PATENT DOCUMENTS 2,045,157 A 6/1936 Robert
2,121,204 A 6/1938 Langworthy
2,150,069 A 3/1939 Koleno
2,237,368 A 4/1941 Seitzman et al.
2,675,556 A 10/1952 Collier
3,099,013 A 7/1963 Thrope
D214,356 S 6/1969 Jarrett
3,911,497 A 10/1975 Lewis, Jr. et al.
4,016,027 A 4/1977 Kintanar
4,068,316 A 1/1978 Haywood
4,229,833 A 10/1980 Cox et al.
4,554,682 A 11/1985 Hillquist
4,570,267 A 2/1986 Appel
4,601,066 A 7/1986 Campbell
4,706,304 A 11/1987 Jones
4,771,518 A 9/1988 Lapointe et al.
D299,562 S 1/1989 Lee
4,977,622 A 12/1990 Schley
4,985,934 A 1/1991 Perry
5,088,166 A 2/1992 Lavinio
5,187,813 A 2/1993 Klien
5,375,261 A 12/1994 Lipke
5,542,121 A 8/1996 Lahaussois et al.
5,628,064 A 5/1997 Chung
5,682,616 A 11/1997 Pisano
5,720,044 A * 2/1998 Robinson ..... A41B 1/00 2/77
5,734,992 A 4/1998 Ross
5,761,746 A 6/1998 Brown
D408,966 S 5/1999 Lawrence
5,918,315 A 7/1999 Trachtenberg
5,974,586 A 11/1999 Reinoso
6,052,824 A 4/2000 May
D431,343 S 10/2000 Sampson
D442,765 S 5/2001 Newman
D463,092 S 9/2002 Perez
6,813,779 B1 11/2004 Williams
7,028,342 B1 4/2006 Nordstrom et al.
D572,435 S 7/2008 Bily et al.
7,429,206 B2 * 9/2008 Perry ..... A41F 15/02 450/86
D600,887 S 9/2009 Willams et al.
7,818,817 B1 10/2010 Owens et al.
D639,024 S 6/2011 Benderradji
D639,928 S 6/2011 Malone
D646,869 S 10/2011 Greenblat
8,075,366 B1 12/2011 Jaksic et al.
8,082,597 B2 12/2011 Young
D655,894 S 3/2012 Crye
D663,925 S 7/2012 Greenblat
D675,811 S 2/2013 Stevens
8,365,313 B2 * 2/2013 Greenblat ..... A41D 1/22 2/69
8,371,901 B2 2/2013 Frey
D677,448 S 3/2013 Bazile
D680,302 S 4/2013 Johson
D680,303 S 4/2013 Greenblat
D683,929 S 6/2013 Bryan
D695,999 S 12/2013 LaKeisha
8,650,662 B2 2/2014 Decker
D703,923 S 5/2014 Marshall
D719,650 S 12/2014 Arinobe
9,314,058 B2 * 4/2016 Bushby ..... A41B 9/06
9,801,419 B2 * 10/2017 Bushby ..... A41B 1/08
D807,628 S 1/2018 Nethongkome
10,568,373 B2 * 2/2020 Bushby ..... A41B 9/06
2004/0064869 A1 4/2004 Deadwyler
2004/0199976 A1 * 10/2004 Hunt ..... A41D 3/00 2/93
2004/0221360 A1 11/2004 Wood et al.
2005/0015843 A1 1/2005 Patel
2008/0047044 A1 * 2/2008 Jones ..... A41D 1/04 2/84
2010/0017937 A1 * 1/2010 Birmingham ..... A43B 3/163 36/7.1 R
2010/0199403 A1 8/2010 Greenblat
2012/0096619 A1 4/2012 Collins
2012/0324615 A1 12/2012 Heimann
2014/0075638 A1 * 3/2014 Larkin ..... A41D 27/10 2/16
2014/0115754 A1 5/2014 Bloomfield
2016/0000150 A1 * 1/2016 Gucciardi ..... A41D 13/0015 2/69

OTHER PUBLICATIONS

SleevIt LLC, International Application No. PCT/US2015/045672, Filing Date: Aug. 18, 2015, International Search Report and Written Opinion (ISR) dated Nov. 9, 2015.
SleevIt LLC, International Application No. PCT/US2015/045672, Filing Date: Aug. 18, 2015, International Preliminary Report on Patentability Dated Feb. 28, 2017.

* cited by examiner

SLEEVED PARTIAL UNDERGARMENT AND GARMENT SYSTEM

CROSS REFERENCE TO RELATED APPLICATIONS

This application is a continuation of U.S. patent application Ser. No. 15/722,691 entitled "SLEEVED PARTIAL UNDERGARMENT AND GARMENT SYSTEM," filed on Oct. 2, 2017, now U.S. Pat. No. 10,568,373, which is incorporated herein by reference in its entirety for all purposes.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

This invention relates to garments, garment systems, and methods of using garments and garments systems useful for warming and protecting the body, especially the upper body.

BACKGROUND

Many people who wear short-sleeved shirts may also want to at least temporarily wear longer sleeves to cover their arms for added warmth, sun protection, abrasion protection, bug protection and the like, while still wearing the short-sleeved garment. It may also be desirable to change back to a short-sleeve configuration; However, the ability to easy remove the longer sleeves may be restricted due to lack of privacy or changing facilities; a user may be forced to wear a long-sleeve shirt, and then roll up the sleeves as the desire to uncover the arms develops. Wearing a long-sleeve shirt can be uncomfortable as conditions change. In many instances, a person simply puts on a jacket, coat, or sweatshirt to provide coverage of the arms, which is not afforded by their short-sleeved apparel. The bulk of carrying a jacket or sweatshirt may be inconvenient. One could also simply wear a long-sleeve garment and a short-sleeve garment together; however, under some conditions, this has the disadvantage of adding multi-layers to the torso region. The two or more fabric layers on the torso of a dual shirt or jacket solution may be more restrictive to the transfer of body heat away from the body than is desired.

Athletes are commonly required by current practice and lack of choice into wearing multi-layers on the torso in order to have the protection from sun and abrasion afforded by long sleeves. By way of example: baseball players often wear short-sleeved uniforms and a long-sleeved undergarment even when temperatures make this less than desirable.

Another disadvantage of wearing multi-layer clothing during sports activities or strenuous exercise is that the amount of perspiration is usually above average. As a result of perspiration, the clothing becomes much less comfortable to wear because of an unpleasant wet feeling on the skin, especially in the areas where the greatest perspiration occurs. At the end of the sports activity or exercise, the areas of the clothing which cover the zones of heavy perspiration remain wet, and both the wearer and the clothing cool off and thus the moisture which comes into contact with the skin is now cold as well. As a result of the subsequent drop in temperature after the end of the athletic activity or exercise, this perspiration also increases the danger of catching cold or of developing muscle stiffness or the like.

It is also often desirable to add temporary protection from the sun, insects, and from air conditioning, such as when on a plane or in a restaurant. A fashion conscious person may be reluctant to add independent, particularly elastic-band attached sleeves to their arms. For example: a golfer may desire to add sleeves to his typically short-sleeve apparel in a fashionable and versatile manner. Golf and tennis apparel with removable/detachable sleeves have not gained user acceptance for multiple reasons such as awkward appearance, and potential irritation and discomfort introduced by fasteners. A fisherman, gardener, or construction worker may desire to add temporary arm protection from the sun, insects, and for warmth and the like, without carrying a bulky jacket or adding a heat trapping second layer over the upper half of the body.

Many people own T-shirts which are only comfortably worn as the outer garment when temperatures allow. Due to the short sleeve configuration of many of these garments the arms are left bare and cold.

It would be useful to provide undergarments, and particularly sleeved partial undershirt garment accessories that may be comfortably worn and easily removed from beneath another garment, e.g., without requiring removal of a shirt worn over the sleeved partial undershirt garment accessory. Provided herein are garment systems, garments and methods of wearing such garments and systems to address these and other limitations of current apparel.

SUMMARY OF THE DISCLOSURE

Described herein are garments (e.g., sleeved partial undershirt garment accessories) garment systems, and methods of using garments and garments systems that may be useful for warming and protecting the body, especially the upper body. Such a garment or garment system may be or may include a sleeved partial undershirt garment accessory that can be removed without requiring removal of an outer garment. A sleeved partial undershirt garment accessory may have a relatively short torso region such that it does not cover (e.g., prevent cooling of) the lower part of a person's torso when the undershirt garment is worn. A sleeved partial undershirt garment accessory may have a relatively long sleeve (e.g., extending beyond the wearer's elbow region, such as ¾ or full-length) that may provide protection, style, warmth, etc. In some cases the sleeve is longer than the sleeve of an outer shirt, such as an outer shirt of a garment system. A sleeved partial undershirt garment accessory may include an arm opening (e.g., a proximal arm opening) configured to allow a garment wearer to easily remove or pull his arm through the opening (and to remove the undershirt) without removing an overlying garment. An arm opening may be continuous with a torso opening of the shirt and may provide a continuous opening to aid a wearer in removing the undershirt without removing the overlying shirt.

A sleeved partial undershirt garment accessory may generally be made from a stretchable fabric and may be configured to fit closely to or lie flatly against a wearer's body, and to fit comfortably under an outer shirt. A stretchable fabric may also allow portions of the undershirt to stretch to aid in its removal and applying (putting on) without removing an outer shirt. Also described are methods of removing an underlying undergarment without removing an overlying garment. Also described are methods of applying or putting on a garment under an outer garment without removing the outer garment.

For example, described herein are sleeved partial undershirt garment accessories that can be removed without requiring removal of another garment worn atop the partial undershirt garment accessory. A sleeved partial undershirt garment accessory may include: a tubular first sleeve configured to be worn on a first arm and extend distally at least ¾ of the length of a wearer's first arm; a proximal first sleeve opening; a tubular second sleeve configured to be worn on the wearer's first arm and extend distally at least ¾ of the full length of a wearer's second arm; a proximal second sleeve opening; a continuous front region extending between the first sleeve and the second sleeve, the front region extending from a neck opening down to a torso opening; and a continuous back region extending between the first sleeve and the second sleeve, the back region extending from the neck opening down to the torso opening; wherein the torso opening extends from and is continuous with a distal-most region of the proximal first sleeve opening and a distal-most region of the proximal second sleeve opening so that the front region and the back region do not connect to each other around the first and second sleeve openings; further wherein the garment accessory includes a stretch material.

In general, the sleeves of the sleeved partial undershirt garment accessory may be any appropriate length but in particular, are configured to extend beyond the arm bend (e.g., beyond the wearer's elbow), and may extend even longer than the wearer's wrists. For example, in some variations the first and second sleeves are full-length sleeves (e.g., configured to cover the full length of a wearer's arms). In some embodiments, the first and second sleeves each extend distally further than 16 inches (e.g., from the torso). In some embodiments, the distance between the distal-most region of the proximal first sleeve opening and an elbow region of the first sleeve is about 70% the distance from the elbow region to a distal end of the first sleeve.

As will be described in greater detail herein, the torso opening of the sleeved partial undershirt garment accessory is continuous with the proximal openings into each sleeve, so that the bottom opening of the shirt opens directly into each sleeve opening and also into the upper torso region of the garment. In some embodiments, the torso opening extends distally down the first and second sleeves beyond the wearer's armpit regions when the garment accessory is worn. In some embodiments the distal-most region of the proximal first sleeve opening is on a back region of the first sleeve and the distal-most region of the proximal second sleeve opening is on a back region of the second sleeve. In some embodiments, the sleeved partial undershirt garment accessory includes a hood extending from the neck opening.

In general, a sleeved partial undershirt garment accessory may include a collar extending from the neck opening. Some embodiments further include a cuff region extending around a distal end of the first sleeve and a second cuff region extending around a distal end of the second sleeve.

In general, the sleeved partial undershirt garment accessories may be made of any appropriate material, and in particular, relatively stretchable materials. For example, a sleeved partial undershirt garment accessory may be made of a microfiber material. In some embodiments, the garment may be made (entirely or in part) of a mesh or 4-way stretch material.

In some embodiments, the portion of the front region bounded by the torso opening extending between the first and second sleeves is curved towards the neck opening, exposing the pectoral region of the wearer. In some embodiments, the portion of the back region bounded by the torso opening extending between the first and second sleeves is curved towards the neck opening.

Also described herein are garment systems including a sleeved partial undershirt garment accessory that can be removed without requiring removal of another garment worn atop the partial undershirt garment accessory. For example, a garment system may include: a first garment having sleeves which extend distally less than ¾ of the full length of a wearer's arm, wherein the first garment is configured to be worn over a wearer's torso; and a sleeved partial undershirt garment accessory configured to be worn beneath the first garment and including: a tubular first sleeve configured to be worn on the wearer's first arm and extend distally at least ¾ of the full length of the wearer's first arm; a proximal first sleeve opening; a tubular second sleeve configured to be worn on the wearer's second arm and extend distally at least ¾ of the full length of the wearer's second arm; a proximal second sleeve opening; a continuous front region extending between the first sleeve and the second sleeve, the front region extending from a neck opening down to a torso opening; and a continuous back region extending between the first sleeve and the second sleeve, the back region extending from the neck opening down to the torso opening; wherein the torso opening extends from and is continuous with a distal-most region of the proximal first sleeve opening and a distal-most region of the proximal second sleeve opening so that the front region and the back region do not connect to each other around the first and second sleeve openings; further wherein the garment accessory includes a stretch material.

Also described herein are methods of removal of a partial undershirt garment accessory without removing a first garment covering the wearer's torso and worn atop the partial undershirt garment accessory. For example, a method of removal may include: urging the partial undershirt garment accessory over the wearer's head, while the partial undershirt garment accessory is worn beneath the first garment, wherein the partial undershirt garment accessory includes: a tubular first sleeve configured to be worn on the wearer's first arm and extend distally at least ¾ of the full length of the wearer's first arm; a proximal first sleeve opening; a tubular second sleeve configured to be worn on the wearer's second arm and extend distally at least ¾ of the full length of the wearer's second arm; a proximal second sleeve opening; a front region extending between the first sleeve and the second sleeve, the front region extending from a neck opening down to a torso opening; and a back region extending between the first sleeve and the second sleeve, the back region extending from the neck opening down to the torso opening; wherein the torso opening extends from, and is continuous with, both a distal-most region of the proximal first sleeve opening and a distal-most region of the proximal second sleeve opening so that the front region and the back region do not connect to each other around the first and second sleeve openings; urging the first sleeve distally until the wearer's first arm, within the first garment, passes through the torso opening; urging the second sleeve distally until the wearer's second arm, within the first garment, passes through the torso opening; and removing the partial undershirt garment accessory from the wearer's body while the first garment is still being worn (e.g., by urging the partial undershirt garment through an opening in the first garment), after the partial undershirt garment accessory has been urged over the wearer's head and the first arm has been passed through the torso opening.

In some variations, the partial undershirt garment accessory is urged over the wearer's head before the first sleeve has been urged distally until the wearer's first arm has passed through the torso opening and before the second sleeve has been urged distally until the wearer's second arm has passed through the torso opening.

The partial undershirt garment accessory may be urged over the wearer's head after the first sleeve has been urged distally until the wearer's first arm has passed through the torso opening.

In some embodiments, the partial undershirt garment accessory is urged over the wearer's head after the first sleeve has been urged distally until the wearer's first arm has passed through the torso opening and after the second sleeve has been urged distally until the wearer's second arm has passed through the torso opening.

Urging the partial undershirt garment accessory over the wearer's head may include pulling the neck opening from behind the wearer's head and over the top of the wearer's head. Removing the partial undershirt garment accessory from the wearer's body may include removing the partial undershirt garment accessory from beneath the first garment through a neck opening of the first garment, and/or pulling the second sleeve distally to remove the partial undershirt garment accessory through a sleeve of the first garment.

In general, when removing the sleeved partial undershirt garment accessory, the wearer may bend his or her arm at the elbow while pulling distally on the sleeve to pass the elbow through the torso opening that is continuous with the proximal sleeve opening; pulling the sleeve distally (e.g., towards the wearer's wrist of the arm on which the sleeve is worn) may extend the torso opening along the back of the wearer's arm so that when the elbow is bent, it may easily pass through the torso opening, while the arm otherwise remains within a shirt or other garment worn over the sleeved partial undershirt garment accessory. For example, in some embodiments, urging the first sleeve distally until the wearer's first arm passes through the torso opening includes stretching the partial undershirt garment accessory to expand the torso opening distally down the wearer's first arm. In some embodiments, urging the second sleeve distally until the wearer's second arm passes through the torso opening includes stretching the partial undershirt garment accessory to expand the torso opening distally down the wearer's second arm.

Also described herein are methods of removal of a partial undershirt garment accessory without removing a first garment covering the wearer's torso and worn atop the partial undershirt garment accessory. For example a method may include the steps of: urging a neck opening of a partial undershirt garment accessory over a wearer's head while the partial undershirt garment accessory is worn beneath the first garment, wherein the partial undershirt garment accessory includes: a first sleeve and a second sleeve, wherein each sleeve has a proximal arm opening into sleeves; a front region extending between the first and second sleeves, the front region extending from the neck opening down to a torso opening; and a back region extending between the first and second sleeves, the back region extending from the neck opening down to the torso opening; wherein the torso opening extends from and is continuous with the proximal arm openings of the first and second sleeves so that the front region and the back region do not connect to each other below the first and second arm openings; urging the first sleeve distally until the wearer's first arm, while still within a first sleeve of the first garment, passes through the torso opening; urging the second sleeve distally until the wearer's second arm, while still within a second sleeve of the first garment, passes through the torso opening; and removing the partial undershirt garment accessory from beneath the first garment.

Also described herein are methods of wearing a sleeved partial undershirt garment with a short-sleeved or sleeveless outer garment that provides sleeves to a wearer while minimizing the restriction of heat flow from the abdomen and creating the appearance of a double shirt arrangement. For example, a method may include: applying a partial undershirt garment accessory to the wearer by, in any order: placing a first arm through a first proximal first sleeve opening and into a tubular first sleeve of the sleeved partial undershirt garment so that the first sleeve extends at least ¾ of a full length of the first arm, placing a second arm through a second proximal sleeve opening and into a tubular second sleeve of the sleeved partial undershirt garment so that the second sleeve extends approximately ¾ of a full length of the second arm, and passing the wearer's head through a neck opening of the sleeved partial undershirt garment accessory, wherein the sleeved partial undershirt garment includes a torso opening extending from and continuous with both the first proximal sleeve opening and the second proximal sleeve opening so that a front region of the sleeved partial undershirt garment extends between the first and second sleeves and between the neck opening and the torso opening, and a back region extends between the first and second sleeves and between the neck opening and the torso opening, wherein the front or the back regions of the torso section do not extend below the diaphragm of the user, whereby the partial undershirt garment does not restrict heat flow from the users abdomen; and applying an outer garment over the sleeved partial undershirt garment, wherein the outer garment has an outer garment first sleeve that is shorter than the first sleeve of the sleeved partial undershirt garment and an outer garment second sleeve that is shorter than the second sleeves of the sleeved partial undershirt garment, thereby creating the appearance of a double shirt configuration.

As mentioned, in any of the sleeved partial undershirt garment accessories described herein, the sleeved partial undershirt garment accessory may be made of (or otherwise include) a stretchable microfiber material.

A portion of the front region, a portion of the back region, or a portion of the front and back regions extending between the first and second sleeves that is bounded by the torso opening may be curved towards the neck opening, exposing the wearer's torso and aiding in ease of removability of the partial undershirt garment.

BRIEF DESCRIPTION OF THE DRAWINGS

FIG. 1A shows the separate outer garment and sleeved partial undershirt garment accessory; FIG. 1B shows a front view of the outer garment applied over the sleeved partial undershirt garment accessory.

FIG. 2A shows a front view of the (flattened) garment. FIG. 2B is an illustration of the sleeved partial undershirt garment accessory of FIG. 2A worn on a torso. FIG. 2C is an example of a back of a sleeved partial undershirt garment accessory such as the one shown in FIG. 2A. FIG. 2D is another example of a back of a sleeved partial undershirt garment accessory such as the one shown in FIG. 2A, having a more laterally (distally) edge of the torso opening at the bottom of the garment.

FIG. 3A is a front view and FIG. 3B illustrates one example of the garment of FIG. 3A worn with an outer garment (a short sleeved shirt in this example). FIG. 3C shows an example of a back view of a sleeved partial undershirt garment accessory such as the one shown in FIG. 3A, and FIG. 3D is a back view of the system including a sleeved partial undershirt garment accessory shown in FIG. 3B.

FIG. 4A is a front view, FIG. 4B is a back view. FIG. 4C is a back view of another variation of a sleeved partial undershirt garment accessory such as the one shown in FIG. 4A.

DETAILED DESCRIPTION

Figure 1A:
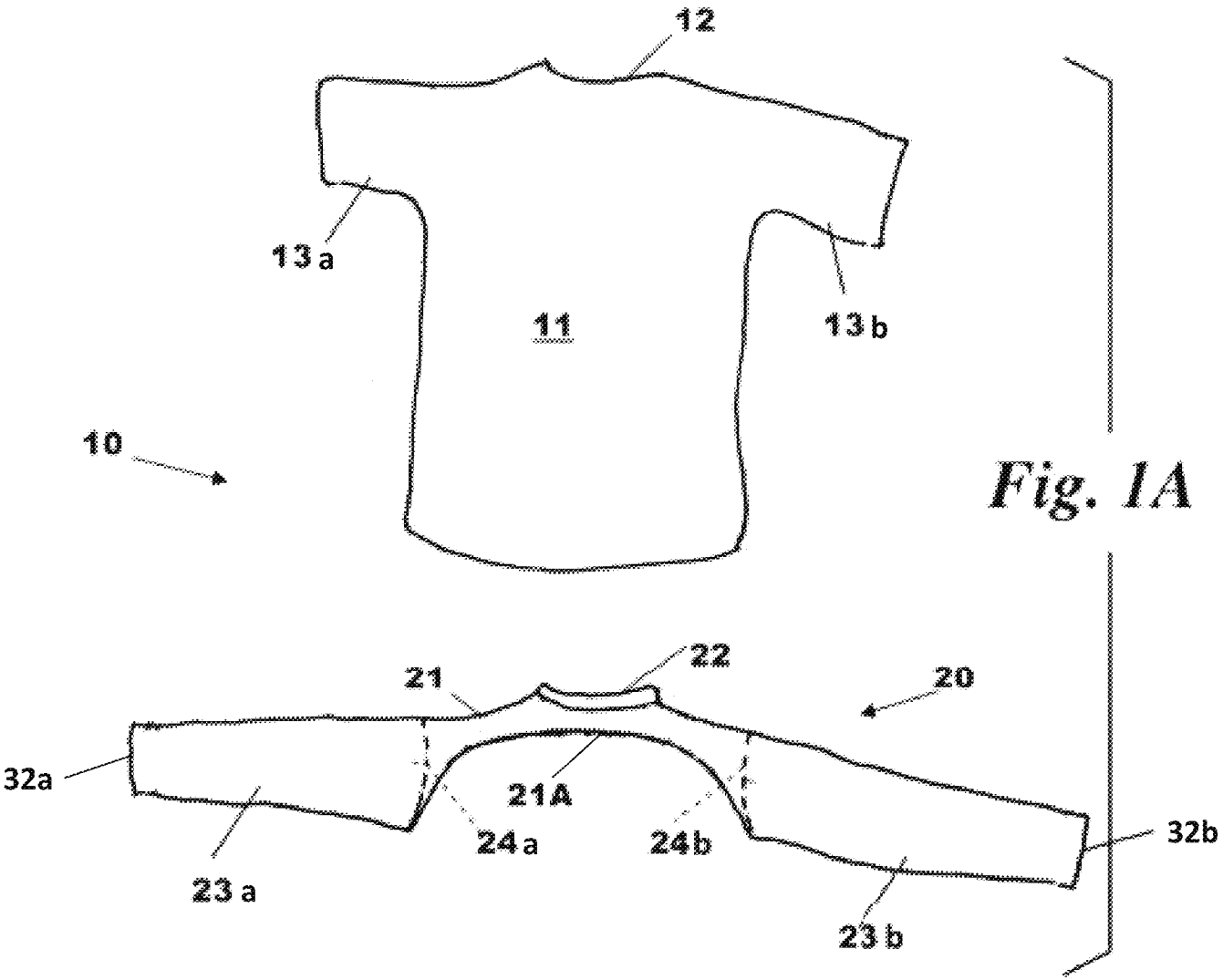
FIGS. 1A-1B show a first example of a garment system with a sleeved partial undershirt garment accessory having a shortened torso region and long sleeves, and an outer shirt, such as a short-sleeved T-shirt that may be worn over the undergarment.

Described herein are garments and garment systems for a person to wear and methods of wearing garments. Specifically, described herein are sleeved partial undershirt garment accessories that may be worn on a subject's torso. In particular, these garments may be worn under another garment (e.g., shirt, undershirt, etc.), yet provide coverage (or in some cases, additional coverage) over the wearer's arms. For example, described herein are sleeved partial undershirt garment accessories for a person to wear on their upper body that extends over the shoulder, a shortened torso region, and sleeves that extend past the elbow. Such a garment may be a sleeved partial undershirt garment accessory worn by a person under an outer garment and may be configured to be easily removed from the wearer without requiring removal of the outer garment. These sleeved partial undershirt garment accessories may be worn next to the skin of an individual or over another garment (such as another undergarment). A sleeved partial undershirt garment accessory may be a stretchy or fitted undershirt that can be stretched and pulled out from underneath the outer garment while the undergarment and outer garment are being worn by a person. Such a garment may be put on (e.g., put on underneath an outer garment) by a person while the person is wearing the outer garment. Such a garment may, for example, be worn when a person starts playing a sport or engaging in another activity (e.g., is "warming-up") to provide warmth or protection to the arms and upper part of the torso and may be easily removable after the person has warmed up and no longer desires the warmth and protection afforded by the undergarment. In some variations, a garment as described herein may have a short torso region with a torso opening that is continuous with the arm openings and configured in such a way as to allow the person's arms (and particularly the bent elbows of the person's arms) to be pulled through the opening so that the garment may be removed from the person (such as over the person's head) while the person continues to wear the overlying outer garment.

The sleeved partial undershirt garment accessories described herein may provide one or more advantages. For example, such a garment may be especially useful for a person who wants extra warmth provided by the stretchy garment for a short period of time and then wants to easily remove the garment while they continue participating in their activity. Such a garment may provide a wearer with an option to quickly and easily change from longer-sleeve garment configuration to a shorter-sleeve garment without distracting the user from their activity, and without requiring a private (changing) facility. Such a garment may be lightweight and easy to remove by a wearer during an activity (e.g., a sporting activity), thus making the wearer's ensemble easily convertible from a long-sleeve to a short-sleeve or sleeveless configuration, and may be easy to transport or be carried by a person (e.g., an athlete). In general, these garments may be lightweight and easy to transport or be carried by a person (e.g., an athlete) and easy to put on before or during an activity (e.g., a sporting activity), thus making the wearer's ensemble easily convertible from a sleeveless or short-sleeve garment to a long-sleeve configuration. Such a garment may be useful for an individual who wants an outer shirt to be visible while wearing the undergarment for protection or another purpose. Such a garment or may provide the wearer with a fashionable garment ensemble having the appearance of a layered shirt arrangement, while not overly restricting heat flow from the wearer's torso. Such a garment may be lightweight and may easily fit into or be carried in a purse or pocket, and may utilize less fabric than would a more extensive or fuller (e.g., full-length) garment (e.g., one that covers more, most or all of the torso) and thus may be more economical than is a jacket or full long-sleeve shirt. The sleeved partial undershirt garment accessory may be lightweight, easily carried and stored in a compact configuration without requiring much space, and may thus be attractive to backpackers, hikers, travelers, a person with gear/baggage weight or size constraint, etc. Such a garment may be less thermally restrictive. For example, a person wearing a sleeved partial undershirt garment accessory may have only one layer of clothing over portions of their torso (due to the abbreviated or shortened torso region of the garment) and may not be overly warmed when wearing the garment. A sleeved partial undershirt garment accessory may be useful for thermoregulation, or maintenance of a constant internal body temperature independent of the environmental temperature, which in humans is effected by metabolic activity and sweating. Such a garment may be useful for providing sun-blocking or sun-screening without adding unwanted extra warmth. Thus, in general, a sleeved partial undershirt garment accessory may be useful for an athlete, construction worker, hiker, outdoorsman, swimmer etc. to provide abrasion protection, insect protection, etc., especially during warm weather.

A sleeved partial undershirt garment accessory may be packaged and sold as an accessory item, usable in many applications and may appeal to wide range of users, and/or with one or more other garments, including an outer shirt.

In general, as described in greater detail below, a sleeved partial undershirt garment accessory may be easily removed as a single garment (or, in some examples, in two or more pieces) from beneath an outer garment while the outer garment is still being worn on the body. Similarly, a sleeved partial undershirt garment accessory may be easily applied to the body as a single garment (or, in some examples, in two or more pieces) even after an outer garment is being worn on the body.

Any of the sleeved partial undershirt garment accessory described herein may not include (and may not require the use of) a fastener, such as a button, drawstring, snap, zipper, or the like, thus making it compatible with a variety of short-sleeve shirts, and reducing potential irritation to the wearer by a fastener. These sleeved partial undershirt garment accessory ("garments") may be lightweight, simple in construction, and inexpensive to manufacture. The sleeves of a long-sleeve undergarment may be interconnected so they are retained together as part of a single garment, thereby reducing the risk of easily getting lost or separated. For example, in some variations the sleeves of the long-sleeve undergarment are supported on the body from the shoulder region, and do require elastic straps around the arms of the wearer. In some examples, the sleeves of an undergarment are secured in place and do not create distraction to a wearer engaged in activities such as competitive athletics.

The sleeved partial undershirt garment accessories may also be referred herein as undershirt garment accessories, sleeved accessories, sleeved partial undershirt garments, undershirt garment, partial undershirt garment accessory, or the like.

Figure 1B:
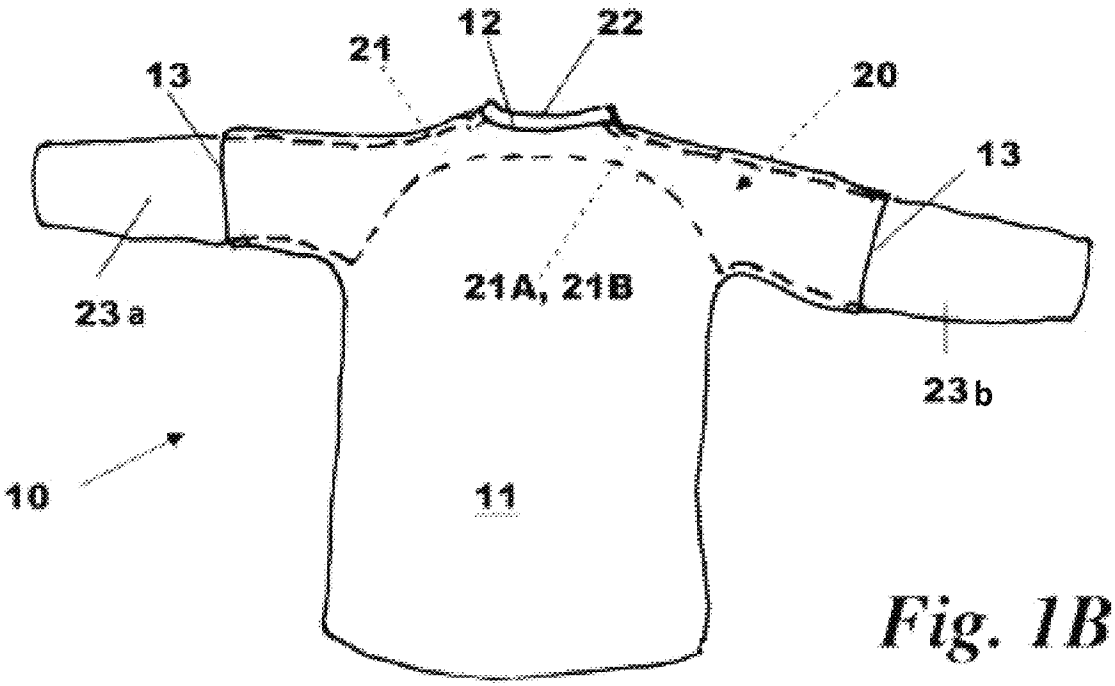
Figure 2A:
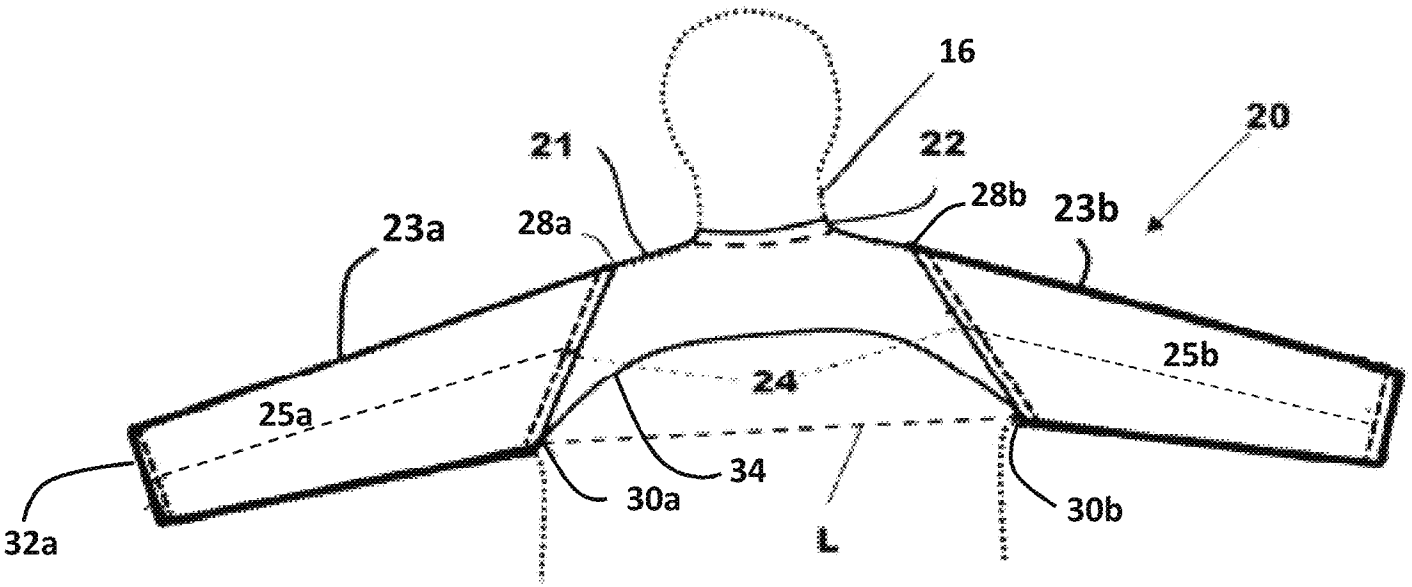
FIGS. 2A-2D illustrate another variation of a sleeved partial undershirt garment accessory that may be worn under an outer (e.g., shirt) garment.
Figure 2B:
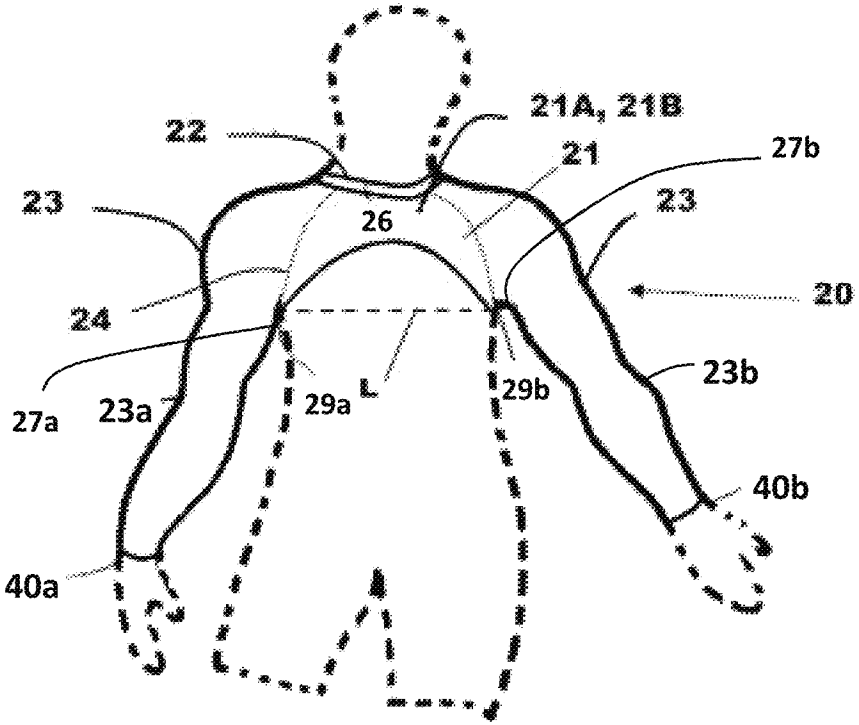
Figure 2C:
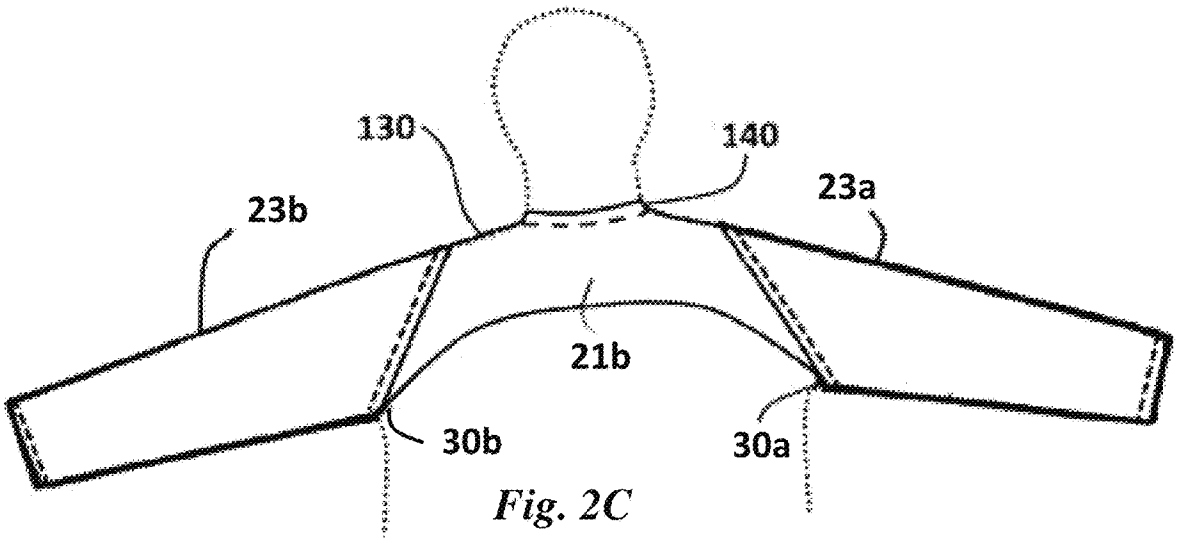

FIGS. 1A-1B and 2A-2C show a garment system 10 with a sleeved partial undershirt garment accessory having a shortened torso region and long sleeves, and an outer shirt, such as a short-sleeved (or long sleeved) T-shirt that may be worn over the undergarment. FIG. 1A shows the garments separately, FIG. 1B shows how the garments may be worn together in layers ("layered") with the long-sleeved undershirt worn underneath the short-sleeved outer shirt, and FIGS. 2A-2C show a sleeved partial undershirt garment accessory alone on a user. (An outer shirt is not shown in this view).

In general, the sleeved partial undershirt garment accessory is stretchy and configured to be easily removable from beneath the outer shirt without removing the outer shirt while the shirts are being worn by a wearer. The undershirt may temporarily provide warmth or protection to the arms or upper torso of a person while it is worn such as while the person is running, skating, or engaging in another athletic event, and may be easily removable such as when the person has warmed up and warmth or protection from the undershirt is no longer desired. A sleeved partial undershirt garment accessory (undershirt or undergarment) as described herein may be configured to cover only part of an individual's torso and may leave part of an individual's torso free from material. An individual's torso is generally the upper portion of the body, excluding the head and limbs, and may also be called the trunk. The torso may be divided into an upper and lower torso, with the upper torso including the region upwards from the waist, and the lower torso including the rest of the trunk. While the upper torso includes both the front and back of the upper part of the body from the waist up, the chest is the upper part of the front of the body.

In general, regions or portions of the garments described herein may be referred to in reference to the corresponding regions of a wearer's body, when the garment is worn on the wearer's body. For example, the torso region of the garment refers to that portion of the garment configured to cover or lie adjacent to the torso of a wearer. Similarly, the armpit region may refer to the region generally over (and/or adjacent to when worn) the subject's armpits. Although garments may be worn by those having different body shapes and sizes, references to a wearer's body region typically (unless the context indicates otherwise) refers to a garment that fits a typical wearer. Sizing may refer to standard garment sizing (e.g., small, medium, large; boy's, girl's, men's, women's, children's, etc.). Examples of standard sizes include: ASTM D5585-95, 2001, Standard Table of Body Measurements for Adult Female, ASTM D6829-02, 2008, Standard Tables of Body Measurements for Juniors, ASTM D5585-11, 2011, Standard Tables of Body Measurements for Adult Female Misses Figure Type, Size Range 00-20, ASTM D6240-98, 2006, ASTM D6240-98 Standard Tables of Body Measurements for Men Sizes Thirty-Four to Sixty (34 to 60), ASTM D6458-99, 2006, Standard Tables of Body Measurements for Boys, Sizes 8 to 14 Slim and 8 to 20 Regular, ASTM D6960-04, 2004, Standard Table of Body Measurements Relating to Women's Plus Size Figure Type, Sizes 14W-32W, CS-151-50—Infants, Babies, Toddlers and Children's clothing, CS-215-58, 1958—Body measurements for the sizing of Women's patterns and apparel, PS 42-70, 1971—Women's Clothing, PS 36-70—Boys Clothing, PS 45-71—Young Men's clothing, PS 54-72—Girls Clothing, etc. Any of the sleeved partial undershirt garment accessories described herein may be sized (and/or may correspond to a user of this sizing) based on one or more standards such as those referenced above.

In FIGS. 1A-1B, outer shirt 11 has outer shirt neck opening 12 for receiving the wearer's head and neck when the shirt is being put on, and outer shirt first and second sleeves 13*a* and 13*b*, respectively, that extend from the shoulder and terminate above the elbow of a wearer. Outer shirt 11 substantially surrounds and covers the shoulders and the torso of a wearer from the neck to the waist. FIGS. 1A-1B and 2A-2C also show undershirt 20. The torso region of undershirt 20 covers the upper portion of the torso and may provide warmth or protection but is short and does not cover the lower part of the torso and so does not provide excessive warmth or unwanted bulk. Undershirt 20 has yoke 21 that encircles a wearer's neck and fits over the shoulders of a wearer and forms undershirt neck opening 22 for receiving the head and neck of a wearer. A yoke is generally a fabric panel (e.g., of the undergarment) that fits around the neck and over the shoulders, and adjoins the proximal ends of the sleeves. Undershirt 20 also has a pair of sleeves, undershirt first sleeve 23*a* and undershirt second sleeve 23*b*, adjoined to opposite (laterally opposed) ends of the yoke (e.g., near the shoulders) and extending from the wearer's shoulder along the arm (e.g., to their wrist). The undershirt first and second sleeves cover a wearer's arms and may provide abrasion protection, bug protection, sun protection, warmth, etc. Undershirt first sleeve 23*a* and undershirt second sleeve 23*b* are tubular with openings on either ends, referred to as "proximal" and "distal" openings, which are relative to a generally longitudinal axis running lengthwise along the sleeve. Undershirt first sleeve 23*a* has undershirt first sleeve proximal opening 24*a* and undershirt first sleeve distal opening 32*a*. Similarly, undershirt second sleeve 23*b* has undershirt second sleeve proximal opening 24*b* and undershirt first sleeve distal opening 32*a*.

The openings are named based on their relative locations to each other along the sleeve and relative to the location where the sleeve adjoins the rest of the undershirt (the yoke). In general, each sleeve defines a proximal-distal axis and may run longitudinally along the sleeve with the proximal ("nearer") end of the sleeve axis being the end closer to the attachment of the sleeve to the yoke (to the torso of the wearer) and the distal end of the sleeve axis being the end further away from the attachment of the sleeve to the yoke (e.g., from the torso region of the wearer when the garment is worn). As illustrated in FIG. 2A, undershirt first sleeve 23*a* also has first sleeve proximal-distal axis 25*a* extending longitudinally (running lengthwise) along the first sleeve and undershirt second sleeve 23*b* has second sleeve proximal-distal axis 25*b* extending longitudinally (running lengthwise) along the second sleeve. A proximal sleeve opening is closer to the proximal end of the axis than is a distal sleeve opening, and thus is also relatively nearer or more proximal to the yoke and wearer's chest in this example. Likewise, a distal sleeve opening is further away from the proximal end of the axis, and thus is relatively further away from or more distal to the yoke and wearer's chest in this example, and is closer to the wearer's hand than is the proximal opening.

As shown in FIGS. 1A-1B and 2A-2C undershirt first sleeve proximal opening 24*a* of undershirt first sleeve 23*a* and undershirt second sleeve proximal opening 24*b* of undershirt second sleeve 23*b* open into and are continuous with torso opening 34, and together form a single, relatively large opening along the bottom of the shirt. Torso opening 34 is configured for receiving the body of a wearer (e.g., when the undershirt is being put on). As described in more detail below, a single large opening on an undershirt may be especially useful for removing an undershirt from a wearer, and may in particular facilitate removing (pulling) a person's arms through the opening and allowing the undershirt to be removed from the wearer without first removing an outer shirt. In illustrated in FIGS. 1A-1B and 2A-2C, part or all of a proximal opening of a sleeve may also be seen to run along a proximal-distal sleeve axis. Thus the proximal opening may have a proximal-distal orientation. Undershirt first sleeve proximal opening 24*a* has first sleeve proximal opening top 28*a* and first sleeve proximal opening bottom 30*a*. Similarly, undershirt second sleeve proximal opening 24*b* has second sleeve proximal opening top 28*b*, and second sleeve proximal opening bottom 30*b*. In this example, the bottoms of the proximal sleeve openings (e.g., 30*a*, 30*b*) are the distal-most region of the proximal sleeve openings and are positioned more distally along the proximal-distal axis than are other parts of the proximal opening. They are, for example, more distally located relative to the tops of their respective proximal openings (e.g. 28*a*, 28*b*) (and the tops of the proximal openings are proximal to the bottoms of the openings). In other examples, a distal-most region of the sleeve opening may not lie at the bottom of the opening. A distal-most region of the sleeve may lie elsewhere than at the bottom of the opening. For example, it may lie at a position intermediate between the top and the bottom of the sleeve opening. It may still, however, be continuous with the torso opening. In some other examples, the distal-most region of the proximal first sleeve opening is on a back region of the first sleeve and a distal-most region of second sleeve opening is on a back region of second sleeve.

Figure 2D:
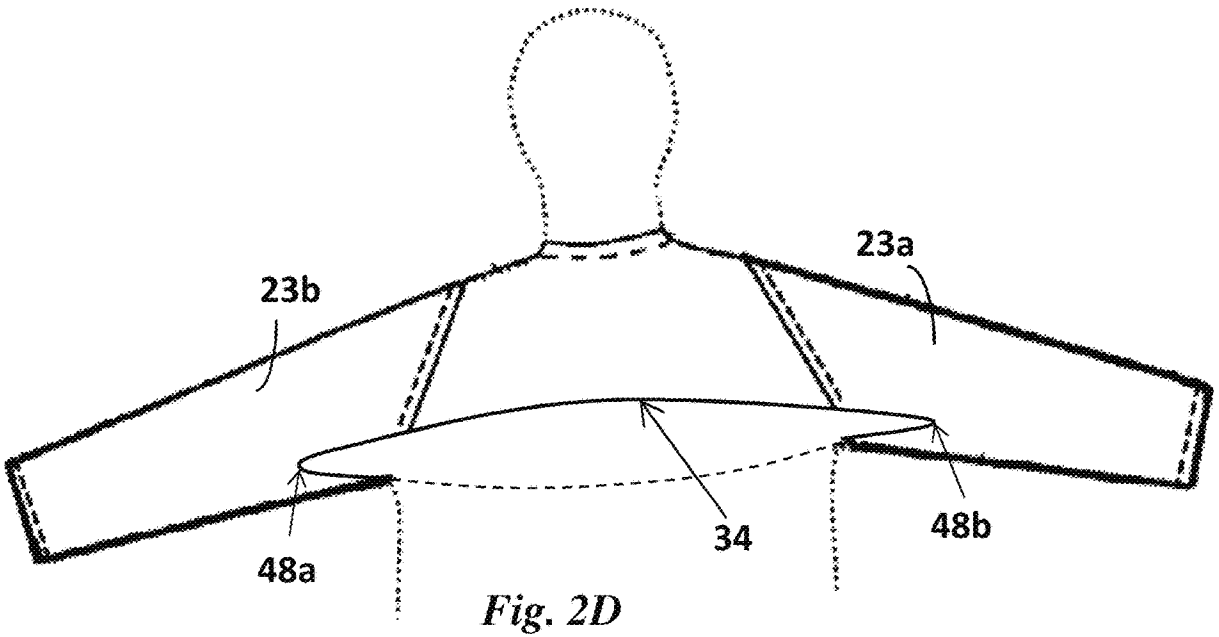

For example, FIG. 2D shows another variation of a sleeved partial undershirt garment accessory from the back, illustrating a variation in which the distal-most regions of the proximal sleeve openings 48*a*, 48*b* are continuous with and form part of the torso opening extend along the back of each sleeve, as shown. In this example, the sleeved partial undershirt garment accessory is shown "flat" with the front of the garment resembling FIG. 2A, while the back has a shape as shown in FIG. 2D. As discussed above, these distal-most edges are located on the back of each sleeve (rather than between the front and back region of the sleeve) so that they would be oriented more closely to the wearer's elbows when the garment is worn. This location may make it easier to pass the elbow through the torso opening 34. Any of the variations described herein may have this configuration of the torso opening, in which the distal-most regions are located on the back of the arms, displaced from the armpit region (towards a position on the back of the sleeve near the elbow). In some variations the distal-most region of the torso opening is a slit extending from the armpit region.

Alternatively or additionally, as mentioned above, the distal-most region of the torso openings 48*a*, 48*b* (e.g., the portion of the torso opening that is continuous with the arm openings), may be made of a more stretchy material than the material comprising the rest of the garment. For example, this region may be made of a nylon, elastic material, which may allow the torso opening to more easily enlarge when pulling (e.g., distally) on the sleeve or another region of the garment to move the wearer's elbow to pass through the torso opening. For example, a more stretchy material (e.g., mesh or other material) may be used in the garment along the proximal end(s) of the sleeves around the armpit area to facilitate ease of removing the garment, allowing an elbow to more easily pass through the torso opening.

In some variations, the distal-most region of the torso opening (e.g., the region around the armpits is made of a material such as a mesh or other highly stretchable material (e.g., more stretchy than the rest of the garment). As described in greater detail below, this region, and in particular the distal-most regions of the torso openings in communication with the arm openings, can be pulled distally to allow the wearers elbows to pass through the torso opening when removing the garment without removing an outer garment first. Thus, by including a more stretchy/elastic material in one or more locations (such as around the distal-most regions of the torso opening) the garment may be more easily removed.

In general, the torso opening of the garments describe herein cuts at or distally beyond the armpit region of the garment, so that the torso opening includes the proximal region of the sleeve openings, and there is connection between the front and the back torso regions (e.g., yoke regions) beneath the sleeve openings.

As mentioned above, FIGS. 1A-1B and 2A-2C show sleeved partial undershirt garment accessory 20 with yoke 21. Yoke 21 covers part of the upper chest and part of the upper back of the wearer's torso when the sleeved partial undershirt garment accessory is worn by a wearer as shown in FIGS. 2A-2C. In particular, it covers the user above an imaginary line L encircling the upper chest and upper back at the underarm area of the wearer. Yoke 21 has a front region (or front yoke portion) 21*a* and a back region (or back yoke portion) 21*b*. In this example, back region 21*b* of yoke 21 is in the same relative place and position in the back of the shirt as is the front region on the front of the shirt, e.g., the back region is a mirror image of the front region, and the description of the front region generally applies to the back region as well (with any relevant reversal regarding orientation). Although shown in this example as having the same shape, in general, however, the front and back regions may instead have different shapes. FIGS. 1A-1B show front region 21*a* is continuous, extending between undershirt first sleeve 23*a* and undershirt second sleeve 23*b* and extending from undershirt neck opening 22 down to torso opening 34.

As indicated above, the first and second tubular sleeved partial undershirt garment accessory sleeves are adjoined to either lateral side of the yoke region. The yoke region is configured to cover (at least part) of the upper chest and/or back. A sleeve may be configured to cover the shoulder and arm and extend distally from its proximal sleeve opening (generally at the shoulder). In general, the sleeves may refer to the region of the garment starting at the shoulder seam (or the comparable position if a shirt lacks a seam) extending distally down the arm.

In FIGS. 2A-2C, first and second sleeves 23*a* and 23*b* are attached to an upper portion yoke 21, respectively at first sleeve seam 31*a* and second sleeve seam 31*b*. The first sleeve and second sleeve proximal openings 24*a*, 24*b* of each of the sleeved partial undershirt garment accessories first sleeve and second sleeves 23*a*, 23*b* extends downward outwardly from the armpit area. As indicated above, the bottom part of the sleeves are not directly attached to the yoke and the bottom of the yoke does not extend laterally to the sleeves. Rather, the torso opening is continuous with the sleeve openings, without intervening sleeve or yoke material. In FIGS. 2A-2C, torso opening 34 extends from and is continuous with undershirt distal-most region of first sleeve proximal opening 30*a* and also with undershirt distal-most region of first sleeve proximal opening 30*b*. As front region 21*a* and back region 21*b* of yoke 21 are followed from their tops to their bottoms, the front and back regions taper and end before they reach the bottom-most part of the first sleeve, e.g., before they extend to the undershirt first sleeve proximal opening bottom 30*a* or undershirt second sleeve proximal opening bottom 30*b*. The front region and the back region (e.g., the yoke) do not connect to each other around the first and second sleeve openings (and the yoke region is discontinuous along its bottom). An opening continuous between a torso opening and a sleeve opening may be useful to facilitate a user removing an arm from an undershirt sleeve (while the user is wearing a garment over the undershirt). In particular, such an opening may provide space for a user's elbow such as when the user bends his elbow while removing (pulling) a sleeve portion of an undershirt from his arm (his forearm) and over his hand. Such an opening may provide space for a user's elbow (e.g., a bent elbow) such as when the user bends his elbow while removing (pulling) a sleeve portion of an undershirt from his arm (his forearm) and over his hand. Although in FIGS. 2A-2D, the sleeves and yoke are separated by seams, in other variations, seams may be different or may be absent. For example, a sleeve and a yoke may be separated by a seam on only one sleeve or only part of one sleeve or may not be separated by any seams or seam. For example, material forming a sleeve and yoke may be a continuous material and a garment may be seamless. In some examples, a material may have a seam, but the seam may be elsewhere, and may not be separating a sleeve from a yoke.

In general, a sleeved partial undershirt garment accessory (e.g., a long-sleeved partial undershirt garment accessory) can be easily removed without having to remove an outer shirt (e.g., a long-sleeved, short-sleeved, or sleeveless outer shirt) by the wearer pulling outwardly on a first sleeve of the sleeved partial undershirt garment accessory to position an arm receiving opening adjacent to their elbow, withdrawing the first elbow, forearm, and hand out of the first sleeve, repeating this process to remove a second arm from a second sleeve of the sleeved partial undershirt garment accessory, then gripping a central portion (e.g., yoke or neck region) and pulling it through the outer shirt neck opening or through one of its laterally opposed sleeves.

In FIGS. 1A-1B and 2A-2C, undershirt 20 is devoid of any material, fabric or panels that would cover the front or back of the wearer's torso below an imaginary line L encircling the upper chest at the underarm area of the wearer. In some other examples, a portion of an undershirt (such as a front bib portion, a back portion, a fringe, a pull-tab, a tie, etc.) may extend below this line, but in general, an undershirt as described herein is configured without material that would substantially cover the front or back of the wearer's torso below the imaginary line L. In general, the lower torso may be covered by an outer shirt, but is not covered by an undershirt. Undergarment 20 and outer shirt 11 may be worn together in an overlaid condition to provide substantially single layer coverage of the wearer's forearms and the wearer's torso below the imaginary line L encircling the upper chest at the underarm area of the wearer.

Figure 3A:
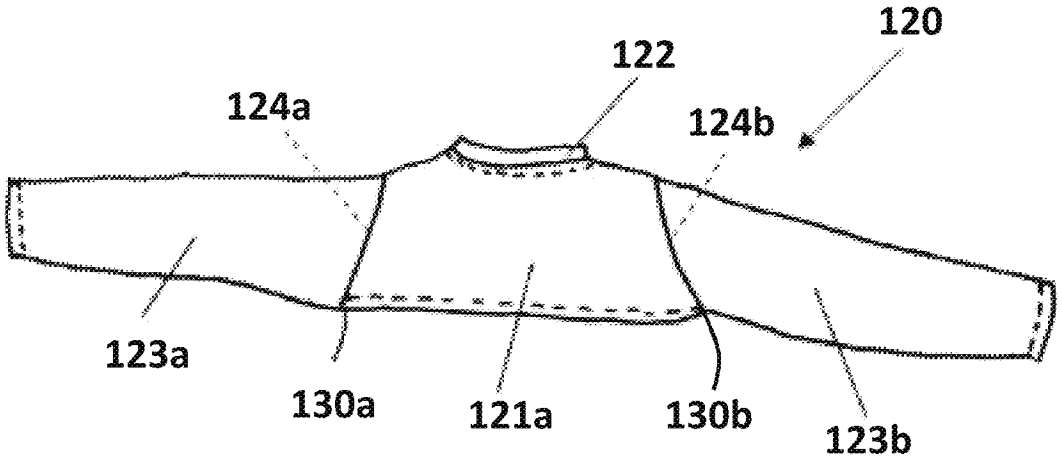
FIGS. 3A-3D show another undergarment system with undershirt having a longer yoke under an outer shirt.
Figure 3B:
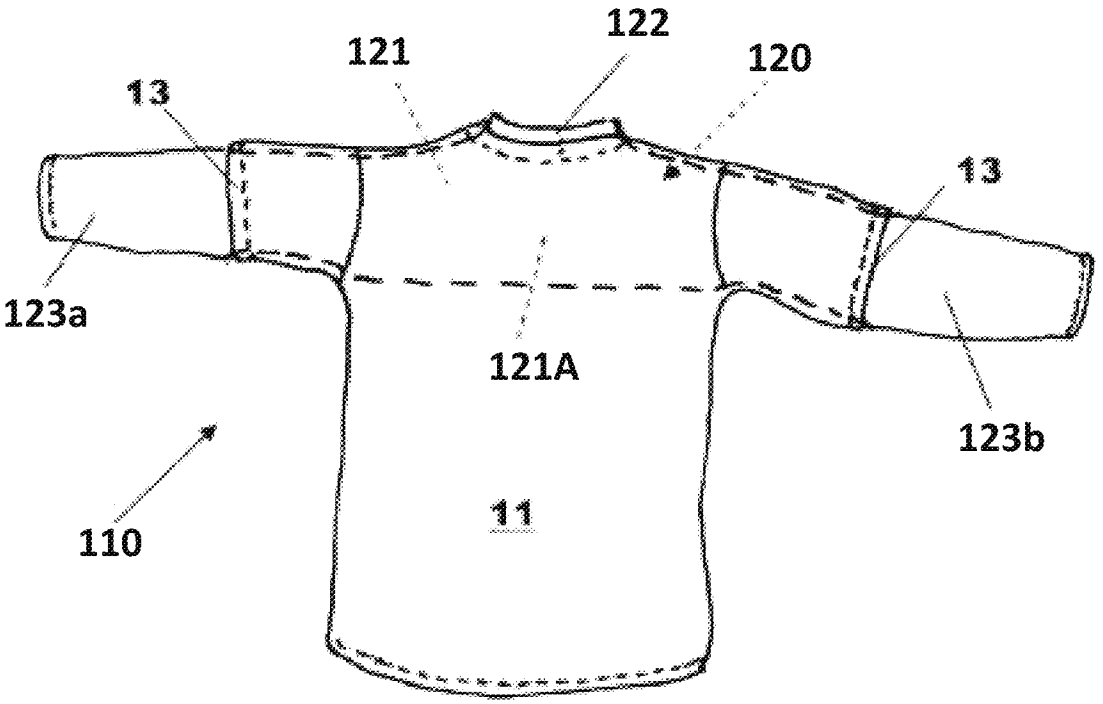
Figure 3C:
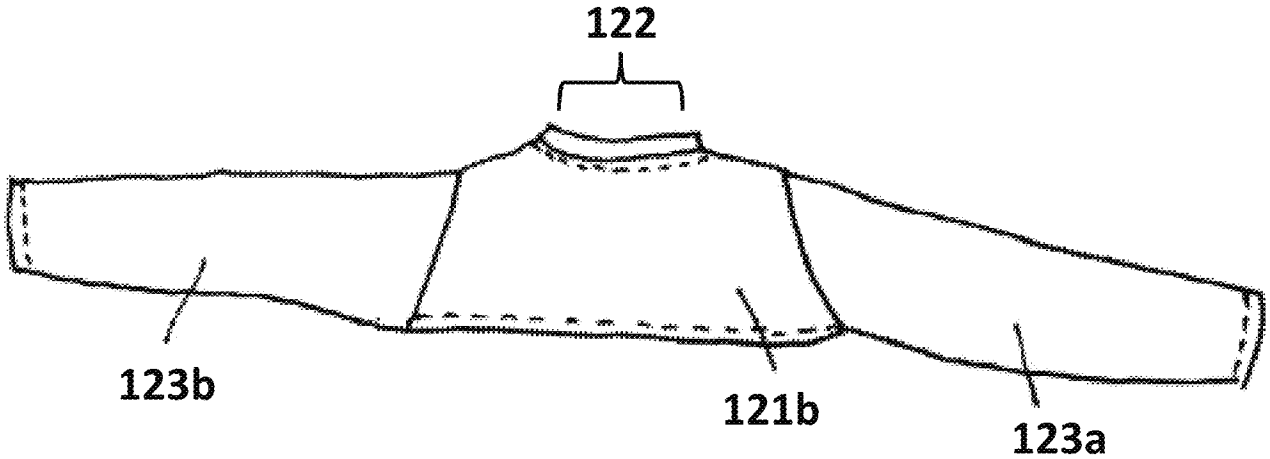
Figure 3D:
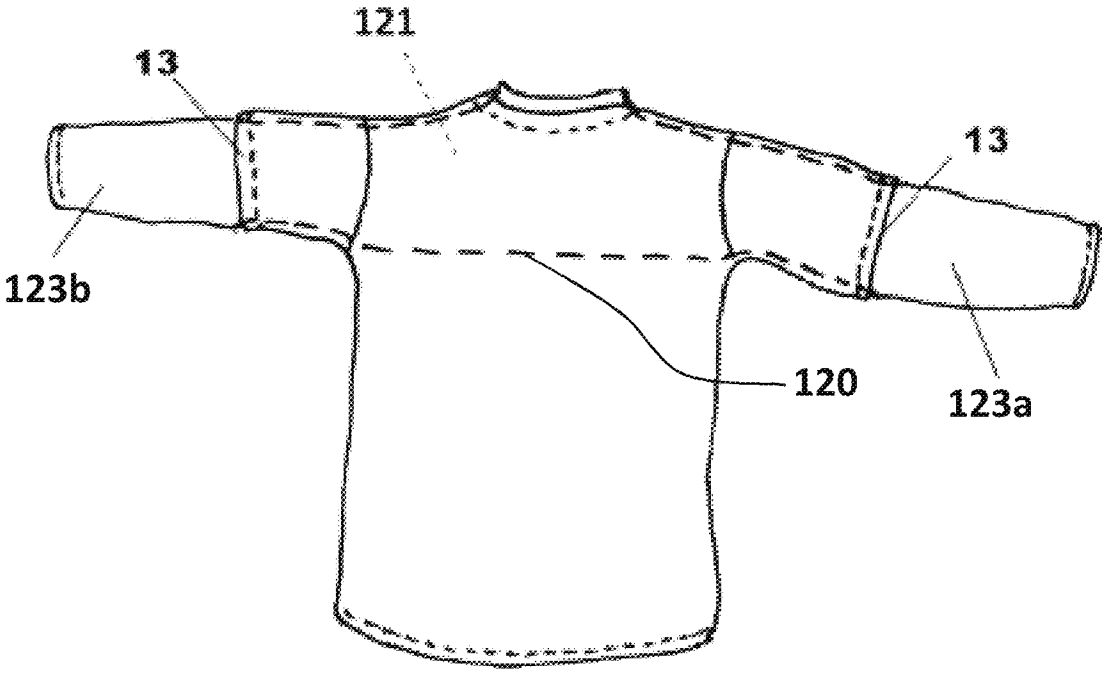

FIGS. 3A-3D show another sleeved partial undershirt garment accessory system 110 with sleeved partial undershirt garment accessory 120 having a longer upper torso region (yoke 121) under outer shirt 11. FIGS. 3A and 3B show front views, respectively, of the sleeved partial undershirt garment accessory alone and under a shirt and FIGS. 3C and 3D show back views. Yoke region 121 fits over the shoulders and includes undershirt neck region 122 that fits around the neck of a wearer. Laterally opposed ends of the front region (front yoke) 121A and rear region (rear yoke) 121B of yoke 121 extend, respectively, to a first sleeve proximal opening bottom 130*a* of first sleeve proximal opening 124*a* of undershirt first sleeve 123*a* and undershirt second sleeve proximal opening bottom 130*b* of undershirt first sleeve proximal opening 124*b* of undershirt first sleeve 123*b*. The front and back yoke regions do not extend further than the bottom of these openings 130*a*, 130*b*, and the front and back yoke regions do not connect around the sleeve openings, although the region of the sleeved partial undershirt garment accessory between the sleeves may extend down (e.g., be curved away from the neck region). Such a sleeved partial undershirt garment accessory with a longer yoke region may, for example, provide additional comfort, style, warmth, etc. The bottom part of the sleeves are directly attached to the yoke and the bottom of the yoke extends laterally to the sleeves in this example. The torso opening is separate from the sleeve openings, and terminates above (in the direction of the head) the sleeve openings. In the example shown in FIG. 3A-3C, sleeved partial undershirt garment accessory 120 is devoid of any material, fabric or panels that would cover the front or back of the wearer's torso below an imaginary line encircling the upper chest at the underarm area of the wearer. In some other examples, a portion of an undershirt (such as a front bib portion, a back portion, a fringe, a pull-tab, a loop, a tie, etc.) may extend below this line, but in general, an undershirt as described herein is configured without material that would substantially cover the front or back of the wearer's torso below the imaginary line. In general, the lower torso may be covered by an outer shirt. Sleeved partial undershirt garment accessory 120 and outer shirt 110 may be worn together in an overlaid condition to provide substantially single layer coverage of the wearer's forearms and the wearer's torso below the imaginary line encircling the upper chest at the underarm area of the wearer.

Figure 4A:
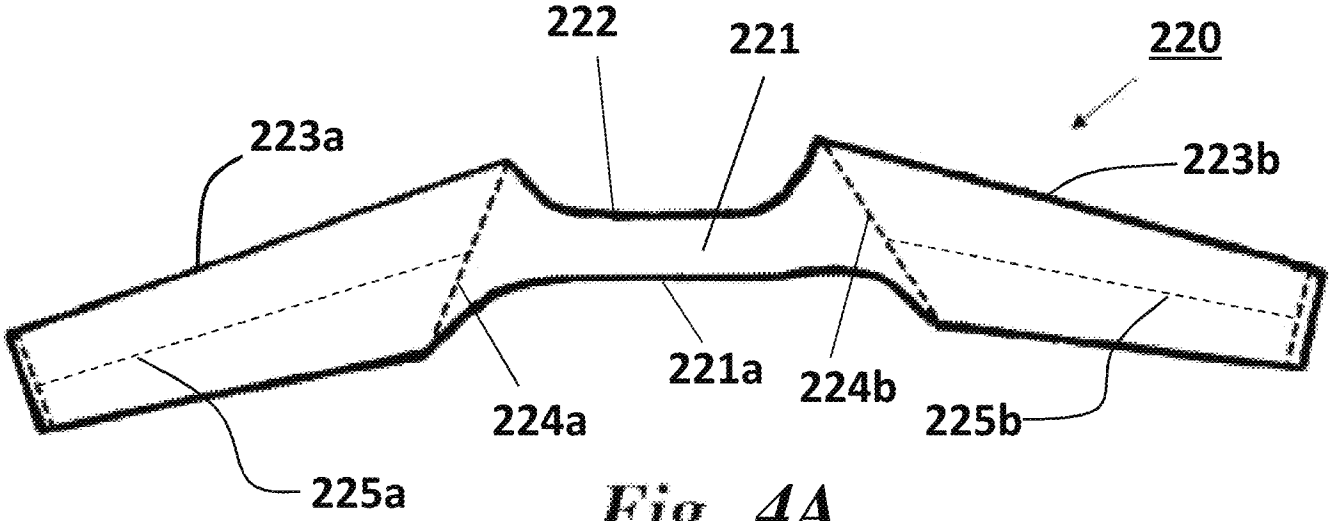
FIGS. 4A-4C show another example of a sleeved partial undershirt garment accessory having a wide low-cut neck opening and having a shorter yoke 221.
Figure 4B:
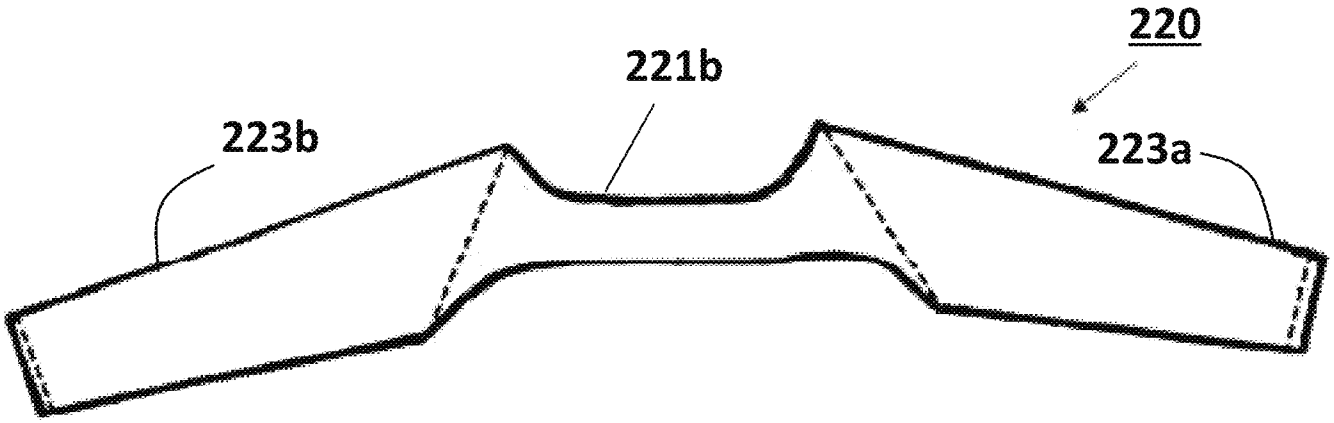
Figure 4C:
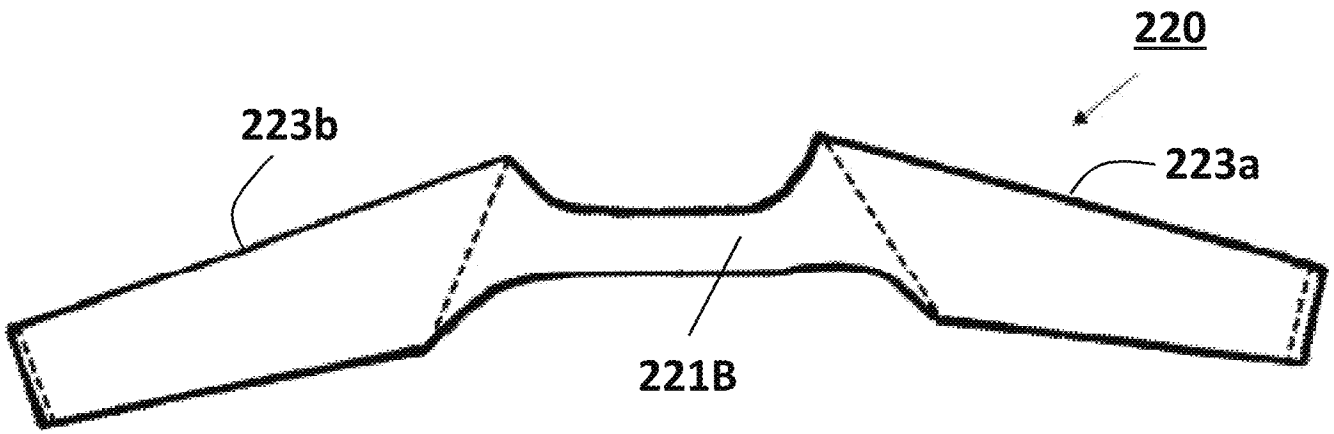

FIGS. 4A-4C show another sleeved partial undershirt garment accessory 220 with a wide low-cut neck opening and having a shorter yoke 221. Sleeved partial undershirt garment accessory 220 has a first sleeve 223*a* and a second sleeve 223*b* which are long sleeves that extend to the wearer's wrists. FIG. 4A show a front view of sleeved partial undershirt garment accessory 220 with front region 221*a*. FIG. 4B show a back view of sleeved partial undershirt garment accessory (which is a mirror image of the front view) and FIG. 4C shows a back view of sleeved partial undershirt garment accessory 220 on a wearer with back region 221*b*. First sleeve 233*a* defines a first sleeve proximal-distal axis 225*a* and second sleeve 233*a* defines a second sleeve proximal-distal axis 225*a*. First and second sleeve proximal openings 224*a*, 224*b* respectively of each of the sleeves 223*a*, 223*b* extend downward outwardly from the shoulder and the laterally opposed ends of front region 221A and back region 221B of yoke 221 adjoined thereto to facilitate withdrawing the wearer's arms from the sleeves (described hereinafter). Front region 221*a* and back region 221*b* extend to first sleeve proximal opening bottom 230*a* and second sleeve proximal opening bottom 230*b* but do not connect to each other around the first and second sleeve openings. Although the front and back regions are shown as mirror images, such regions may be different from each other.

Figure 5A:
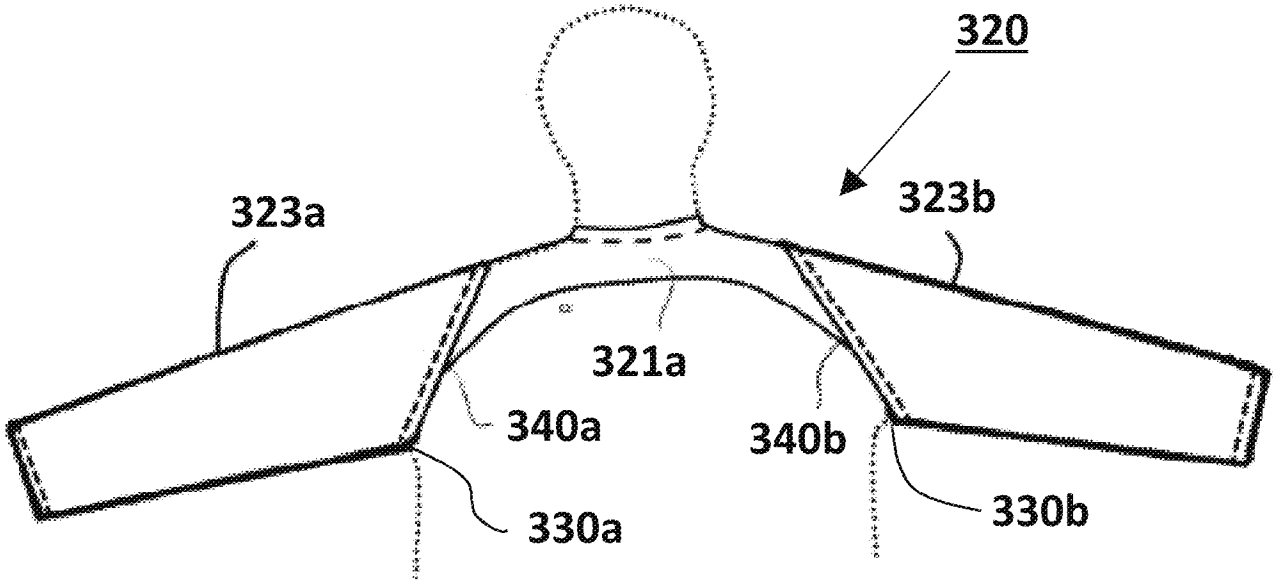
FIGS. 5A and 5B show front and rear views, respectively, of another variation of a sleeved partial undershirt garment accessory, having a high cut torso region.
Figure 5B:
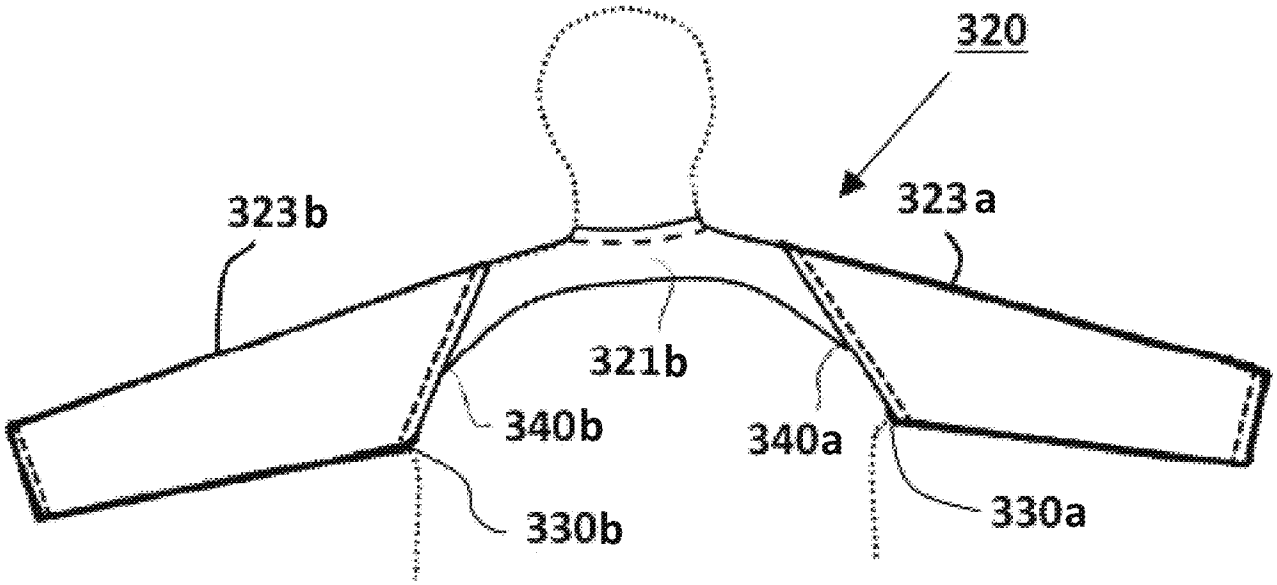

FIGS. 5A-5B show front and rear views, respectively of another sleeved partial undershirt garment accessory 320 with a high cut torso region. The arm openings of each of the sleeves extends downward outwardly from the shoulder and the laterally opposed ends of the front region and back region of yoke adjoined thereto and extends to about the center of the arm-receiving openings leaving an open lower portion of the arm receiving open to facilitate withdrawing the wearer's arms from the sleeves (described hereinafter). Front region 321*a* is high cut and covers part of wearer's upper chest and ends at a first lateral side at first proximal sleeve opening middle 340*a* of first proximal sleeve 323*a* and at a second lateral side at second proximal sleeve opening middle 340*b* of second proximal sleeve 323*b*. Similarly, back region 321*b* of yoke 321 is also high cut and covers part of wearer's upper back and ends at undershirt first proximal sleeve opening middle 342*a* of first proximal sleeve 323*a* and undershirt second proximal sleeve opening middle 342*b* of second proximal sleeve 323*b*. Torso opening 334 is extends from and is continuous with a distal-most region of the proximal sleeve opening 340*a* of first sleeve 323*a* and a distal-most region of proximal sleeve opening 340*b* of second sleeve 323*b*. In some examples, a torso opening extends distally down the first and second sleeves beyond the wearer's armpit regions when the sleeved partial undershirt garment accessory is worn. Such an opening between the torso opening and the proximal sleeve openings may for example reduce an angle at which an elbow needs to bend or a shoulder needs to rotate in order for a shoulder, elbow or arm to be removed from an undershirt. For example, a shirt with a torso opening as described herein may be configured such that an elbow (and arm) may be removed while bending an elbow less than 15°, less than 30°, less than 45°, less than 60°, less than 90°, or less than 120° or between any of these amounts (such as between 30° and 60°. For example, a sleeved partial undershirt garment accessory with a torso opening as described herein may be configured such that an elbow (and arm) may be removed while rotating a shoulder less than 70°, less than 60°, less than 50°, less than 40°, less than 30°, less than 20°, or less than 10°. For example, sleeve or torso or portion or a sleeve or torso of an undershirt as described herein may be compliant, stretchy or otherwise configured to twist or rotate (relative to another portion of the sleeve or torso or to the arm or torso of a wearer) to aid in putting a garment on or removing a garment). For example a sleeve or torso or portion or a sleeve or torso of an undershirt may be configured to twist or rotate more than 180°, more than 120°, more than 90°, more than 60°, more than 30°, or more than 10° (or in between any of these amounts).

Some variations include methods of removing a sleeved partial undershirt garment accessory such as those undershirt garments described herein and especially those described above. These methods may include removing a sleeved partial undershirt garment accessory without removing a first garment covering the wearer's torso and worn atop the partial undershirt garment accessory. For example, the first garment may not be removed from the wearer's head, the wearer's body, or the wearer's arm(s). The method may include urging the sleeved partial undershirt garment accessory over the wearer's head, while the sleeved partial undershirt garment accessory is worn beneath the first garment, wherein the sleeved partial undershirt garment accessory includes a tubular first sleeve configured to be worn on the wearer's first arm, a proximal first sleeve opening; a front region extending between the first sleeve and the second sleeve, the front region extending from a neck opening down to a torso opening; and a back region extending between the first sleeve and the second sleeve, the back region extending from the neck opening down to the torso opening; urging the first sleeve distally until the wearer's first arm, within the first garment, passes through the torso opening; removing the sleeved partial undershirt garment accessory from the wearer's body while the first garment is still being worn, after the sleeved partial undershirt garment accessory has been urged over the wearer's head and the first arm has been passed through the torso opening. Similarly, and as described in more detail below, any of the sleeved partial undershirt garment accessory may also be applied (put on) without having to remove an outer garment.

In general, a sleeved partial undershirt garment accessory (such as those described above or herein) may include tubular sleeves that extend distally at least ¼, ½, ¾ of the full length of the wearer's first arm or extends all the length or beyond the length of the wearers arm. In some variations a method of removal of a partial undershirt garment accessory (such as those described above or herein) includes a sleeved partial undershirt garment accessory with a tubular second sleeve configured to be worn on the wearer's second arm. In some variations a method of removal of a partial undershirt garment accessory (such as those described above or herein), such a tubular second sleeve extends distally at least ¼, ½, or ¾ of the full length of the wearer's first arm or extends all the length or beyond the length of the wearers arm, and includes a proximal second sleeve opening. In some variations a method of removal of a partial undershirt garment accessory (such as those described above or herein), the method further includes urging the second sleeve distally until the wearer's second arm, within the first garment, passes through the torso opening. In some variations a method of removal of a sleeved partial undershirt garment accessory (such as those described above or herein), the torso opening extends from, and is continuous with, both a distal-most region of the proximal first sleeve opening and a distal-most region of the proximal second sleeve opening so that the front region and the back region do not connect to each other around the first and second sleeve openings.

A method of removal of a sleeved partial undershirt garment accessory without removing a first garment covering the wearer's torso and worn atop the partial undershirt garment accessory, the method including: urging the partial undershirt garment accessory over the wearer's head, while the partial undershirt garment accessory is worn beneath the first garment, wherein the sleeved partial undershirt garment accessory includes: a tubular first sleeve configured to be worn on the wearer's first arm and extend distally at least ¾ of the full length of the wearer's first arm; a proximal first sleeve opening; a tubular second sleeve configured to be worn on the wearer's second arm and extend distally at least ¾ of the full length of the wearer's second arm; a proximal second sleeve opening; a front region extending between the first sleeve and the second sleeve, the front region extending from a neck opening down to a torso opening; and a back region extending between the first sleeve and the second sleeve, the back region extending from the neck opening down to the torso opening; wherein the torso opening extends from, and is continuous with, both a distal-most region of the proximal first sleeve opening and a distal-most region of the proximal second sleeve opening so that the front region and the back region do not connect to each other around the first and second sleeve openings; urging the first sleeve distally until the wearer's first arm, within the first garment, passes through the torso opening; urging the second sleeve distally until the wearer's second arm, within the first garment, passes through the torso opening; and removing the partial undershirt garment accessory from the wearer's body while the first garment is still being worn, after the partial undershirt garment accessory has been urged over the wearer's head and the first arm has been passed through the torso opening.

In some variations of a method of removal of a sleeved partial undershirt garment accessory (such as those described above or herein), the sleeved partial undershirt garment accessory is urged over the wearer's head before the first sleeve has been urged distally until the wearer's first arm has passed through the torso opening and before the second sleeve has been urged distally until the wearer's second arm has passed through the torso opening. In some variations of a method of removal of a partial undershirt garment accessory (such as those described above or herein), the partial undershirt garment accessory is urged over the wearer's head after the first sleeve has been urged distally until the wearer's first arm has passed through the torso opening. In some variations of a method of removal of a partial undershirt garment accessory (such as those described above or herein), the partial undershirt garment accessory is urged over the wearer's head after the first sleeve has been urged distally until the wearer's first arm has passed through the torso opening and after the second sleeve has been urged distally until the wearer's second arm has passed through the torso opening. In some variations of a method of removal of a partial undershirt garment accessory (such as those described above or herein), urging the partial undershirt garment accessory over the wearer's head includes pulling the neck opening from behind the wearer's head and over the top of the wearer's head. In some variations of a method of removal of a partial undershirt garment accessory (such as those described above or herein), removing the partial undershirt garment accessory from the wearer's body includes removing the partial undershirt garment accessory from beneath the first garment through a neck opening of the first garment. In some variations of a method of removal of a partial undershirt garment accessory, removing the partial undershirt garment accessory from the wearer's body includes pulling the second sleeve distally to remove the partial undershirt garment accessory through a sleeve of the first garment. In some variations of a method of removal of a partial undershirt garment accessory (such as those described above or herein), urging the first sleeve distally until the wearer's first arm passes through the torso opening includes stretching the partial undershirt garment accessory to expand the torso opening distally down the wearer's first arm.

In some examples, a method of removal of a partial undershirt garment accessory without removing a first garment covering the wearer's torso and worn atop the partial undershirt garment accessory includes urging a neck opening of a partial undershirt garment accessory over a wearer's head while the partial undershirt garment accessory is worn beneath the first garment, wherein the partial undershirt garment accessory includes: a first sleeve having a proximal arm opening into sleeves; a front region; the front region extending from the neck opening down to a torso opening; and a back region extending to the first sleeve, the back region extending from the neck opening down to the torso opening; wherein the torso opening extends from and is continuous with the proximal arm opening of the first so that the front region and the back region do not connect to each other below the first arm openings; urging the first sleeve distally until the wearer's first arm, while still within a first sleeve of the first garment, passes through the torso opening; removing the partial undershirt garment accessory from beneath the first garment. In some variations of a method of removal of a partial undershirt garment (such as those described above or herein), the partial undershirt garment includes a second sleeve with a proximal arm opening into sleeves and the method includes urging the second sleeve distally until the wearer's second arm, while still within a second sleeve of the first garment, passes through the torso opening. In some examples of a method of removal of a partial undershirt garment (such as those described above or herein), the partial undershirt garment includes a second sleeve, and the front region of the partial undershirt garment extends between the first and second sleeves. In some examples of a method of removal of a partial undershirt garment (such as those described above or herein), the partial undershirt garment includes a second sleeve, and the back region of the partial undershirt garment extends between the first and second sleeves. In some examples of a method of removal of a partial undershirt garment (such as those described above or herein), the partial undershirt garment includes a second sleeve with a proximal arm opening, and the torso opening extends from and is continuous with the proximal arm openings of the first and second sleeves so that the front region and the back region do not connect to each other below the first and second arm openings.

Provided herein is a method of wearing a sleeved partial undershirt garment with a short-sleeved or sleeveless outer garment that provides sleeves to a wearer while minimizing the restriction of heat flow from the abdomen and creating the appearance of a double shirt arrangement, the method including: applying a partial undershirt garment accessory to the wearer by, in any order: placing a first arm through a first proximal first sleeve opening and into a tubular first sleeve of the sleeved partial undershirt garment so that the first sleeve extends at least ¾ of a full length of the first arm, placing a second arm through a second proximal sleeve opening and into a tubular second sleeve of the sleeved partial undershirt garment so that the second sleeve extends approximately ¾ of a full length of the second arm, and passing the wearer's head through a neck opening of the sleeved partial undershirt garment accessory, wherein the sleeved partial undershirt garment includes a torso opening extending from and continuous with both the first proximal sleeve opening and the second proximal sleeve opening so that a front region of the sleeved partial undershirt garment extends between the first and second sleeves and between the neck opening and the torso opening, and a back region extends between the first and second sleeves and between the neck opening and the torso opening, wherein the front or the back regions of the torso section do not extend below the diaphragm of the user, whereby the partial undershirt garment does not restrict heat flow from the users abdomen; and applying an outer garment over the sleeved partial undershirt garment, wherein the outer garment has an outer garment first sleeve that is shorter than the first sleeve of the sleeved partial undershirt garment and an outer garment second sleeve that is shorter than the second sleeves of the sleeved partial undershirt garment, thereby creating the appearance of a double shirt configuration. In some variations of a method of wearing a sleeved partial undershirt garment the partial undershirt garment accessory includes a stretchable microfiber. In some variations of a method of wearing a sleeved partial undershirt garment the partial undershirt garment accessory wherein a portion of the front region, a portion of the back region, or a portion of the front and back regions extending between the first and second sleeves that is bounded by the torso opening is curved towards the neck opening, exposing the wearer's torso and aiding in ease of removability of the partial undershirt garment.

Figure 6A:
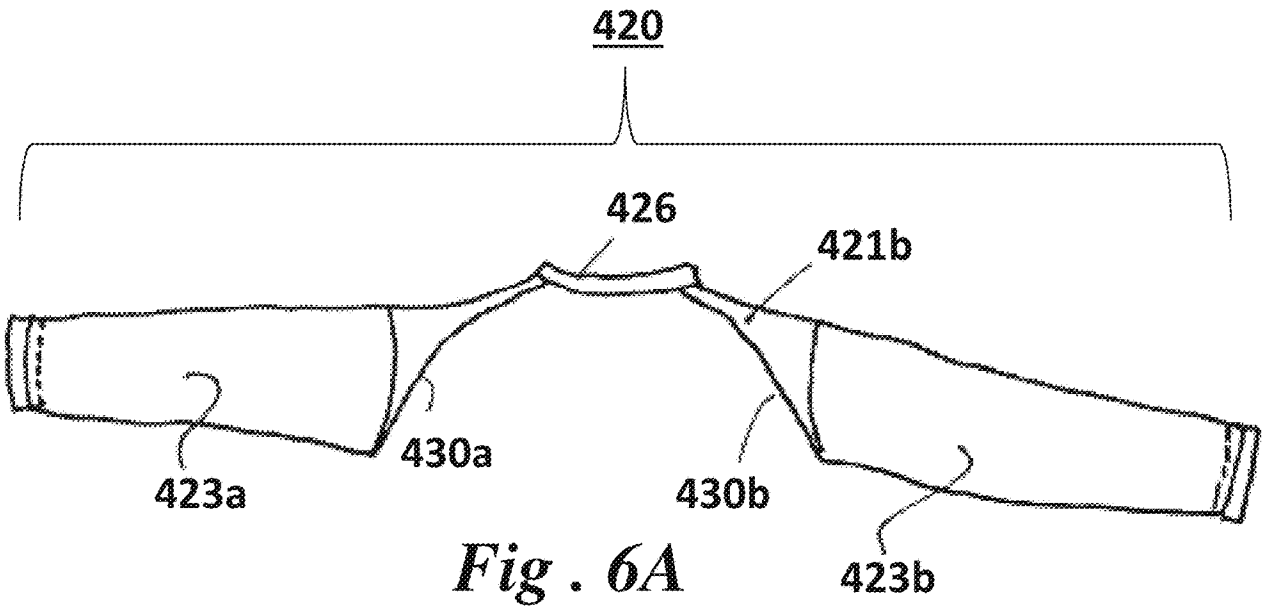
FIGS. 6A and 6B show front and top views, respectively, of another variation of a sleeved partial undershirt garment accessory, having a neck region and minimal yoke.
Figure 6B:
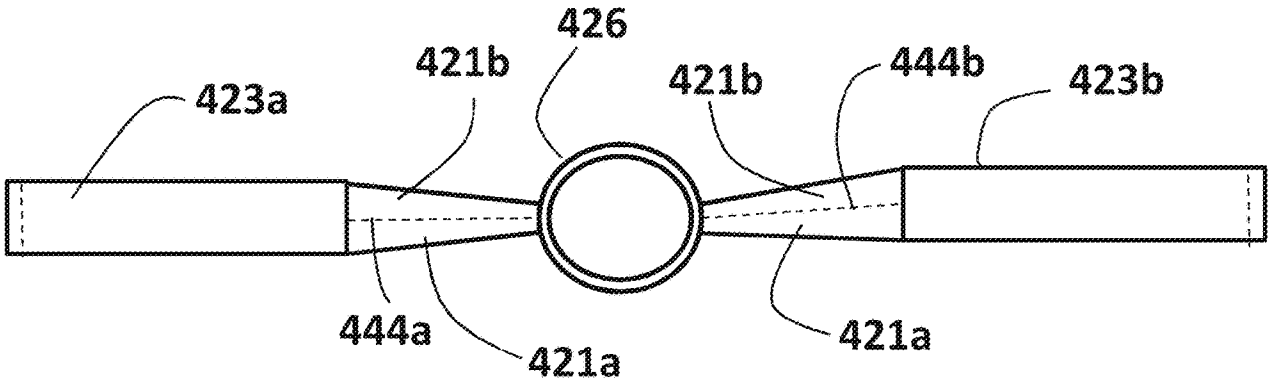

FIG. 6A-6B show front and top views of another sleeved partial undershirt garment accessory 420 with a neck region and minimal yoke. Front region 421*a* of the yoke is divided into first front panel segment 441*c* and second front panel segment 441*d* and the first and second front panel segments are joined and held to each other by collar 426. In this example, the collar is continuous around its circumference and is made from a continuous material, such as a crewneck collar, etc. In some examples a collar as described herein and for this example may instead be discontinuous. For example, such a collar may be separated or separable along its long axis. Such a collar may be relatively rigid and may be held in position (e.g., relative to each other or when in place on a wearer) due to the material rigidity. Two ends of a discontinuous collar may be releaseably fastened together by a fastener. In some examples, a collar may be made from two (or more) separate or separable pieces and may be held together by a fastener, such as a fastener at or near the front and back midlines. Examples of fasteners that may be used include those described elsewhere herein such as buttons, magnetic fasteners, snaps, zippers, etc. for fastening or as known in the art. FIGS. 6A-6B also show back region 421*b* is similarly divided into a first panel and second panels joined by collar 426. Front region 421*a* is joined to back region 421*b* along line 448. Line 448 may be a seam that joins the front region to the back region or may be an imaginary line at the top of the garment that separates the front region that covers part of the chest and front and part of the top of the shoulders and the back region that covers part of the back and the back and part of the top part of the shoulders. Similarly as described herein for some other garment variations, as front region 421*a* and back region 421*b* of yoke 421 are followed from their tops to their bottoms, the front and back regions taper and end before they reach the bottom-most part of the first sleeve, e.g., before they extend to the undershirt first sleeve proximal opening bottom 430*a* or undershirt second sleeve proximal opening bottom 430*b*. In other words, the front region and the back region (e.g., the yoke) do not connect to each other around the first and second sleeve openings and the yoke is discontinuous along its bottom. Similarly as described herein for some other garment variations, the bottom parts of the sleeves are not directly attached to the yoke and the bottom of the yoke does not extend laterally to the sleeves in this example. Rather, the torso opening is continuous with the sleeve openings, without intervening sleeve or yoke material.

Figure 7:
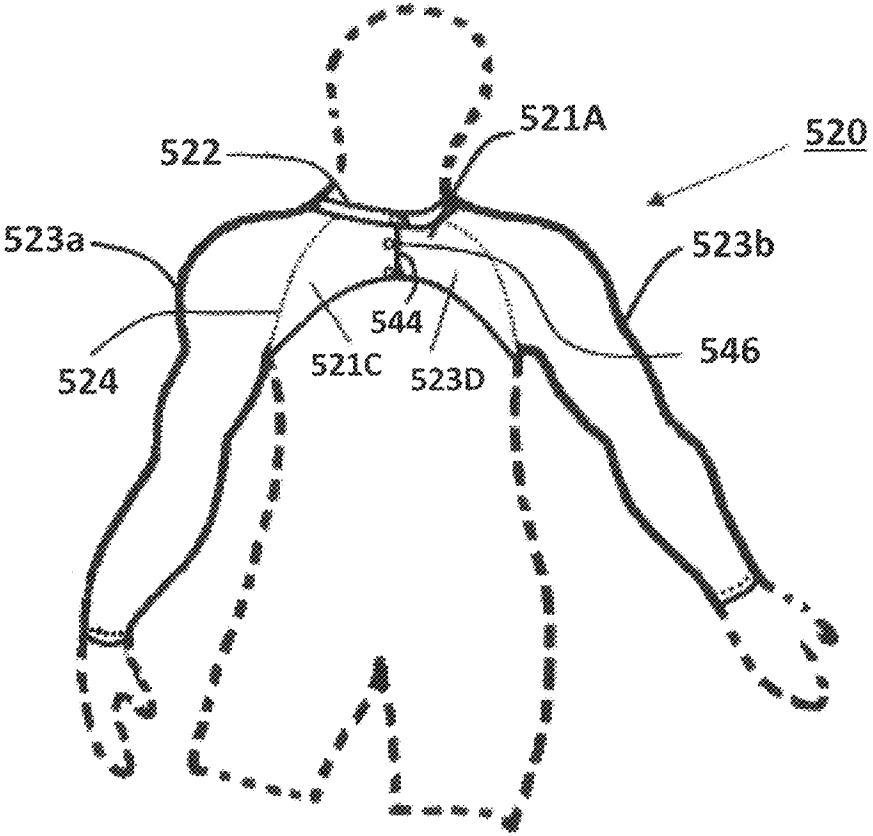
FIG. 7 shows a variation of a sleeved partial undershirt garment accessory with a front region and collar that may be releaseably fastened together. In some variations the fasteners may be "mock" fasteners, which give the appearance of fasteners, but are not needed to secure the left and right side together.

FIG. 7 shows another variation of a sleeved partial undershirt garment accessory with a front region and collar that may be releaseably fastened together (e.g., may be opened). FIG. 7 shows front view of an undergarment 520. Yoke 521 has front region 521A formed of first front panel segment 521C and second front panel segment 521D, each respectively adjoined to undershirt first sleeve 523*a* and undershirt second sleeve 523*b*. First front panel segment 521C and second front panel segment 521D overlap at their proximal ends to form front placket 544. Placket 544 is releasably fastened together by a fastener 546. A fastener may be any such as those described herein (a button, a snap, a zipper, etc.) or as known in the art. An opened front panel may be useful for putting a garment on a user or removing a garment from a user, such as without first removing another garment worn by a user. FIG. 7 also has a back panel (not shown) which may be any, such as described elsewhere herein. In some examples, the back panel may be a continuous piece as described herein. In some examples, the back panel may be discontinuous (e.g., may be two pieces and may be open or may be removably held together by a fastener).

Figure 8:
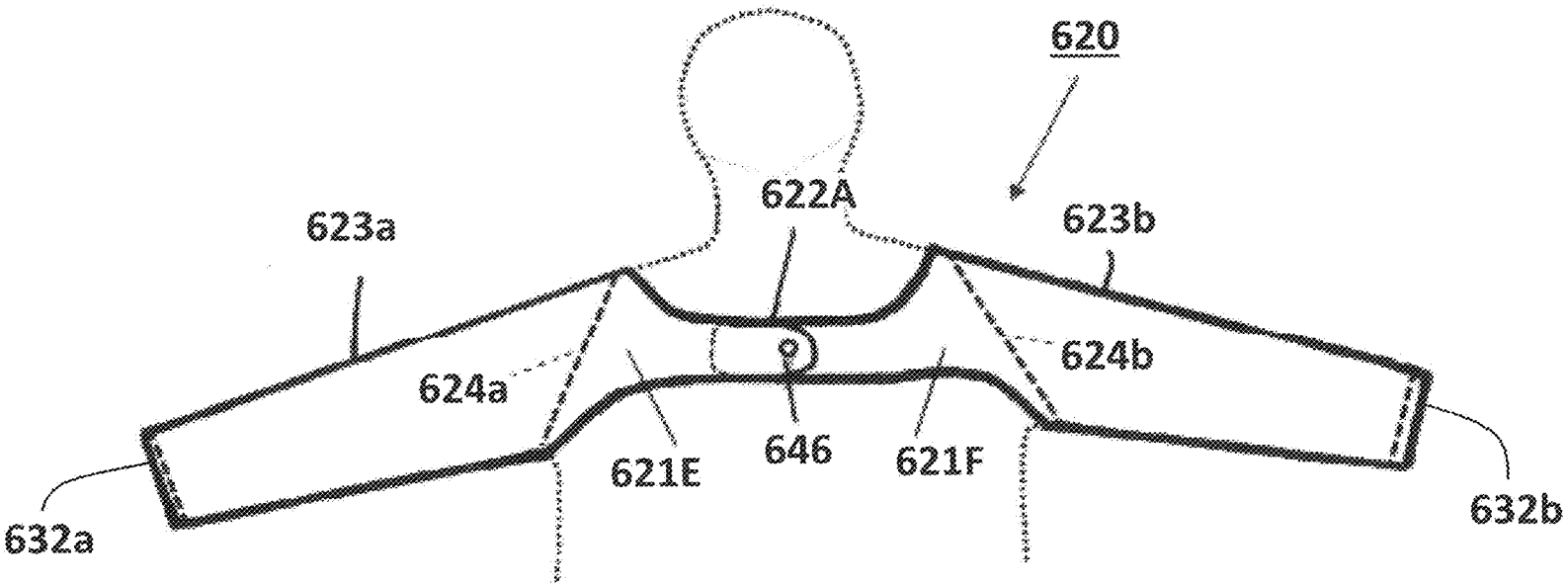
FIG. 8 shows another a variation of a sleeved partial undershirt garment accessory having a two-part back region.

FIG. 8 shows another sleeved partial undershirt garment accessory 620 with a two-part back region. Yoke 621 has a rear panel 621B adjoined to the first and second sleeves 623*a*, 623*b*. Back region 621B is formed of first and second back panel segments 621E and 621F, respectively, each adjoined at a distal end to a respective undershirt first sleeve or second sleeve proximal opening 624*a* and 624*b*, and overlapped at a proximal end at overlap 622*a*, and releasably fastened together by fastener 646.

Long-sleeved undergarment 620 can be easily removed without having to remove an outer shirt 11 (e.g., an outer short-sleeve shirt) by the wearer pulling outwardly on a first long sleeve (e.g., 623*a* or 623*b*) to position the respective undershirt first sleeve or second sleeve proximal opening 624*a* or 624*b* (arm receiving opening) adjacent to their elbow, withdrawing the elbow, forearm, and hand out of the first sleeve, repeating this process for the second sleeve and arm, then gripping yoke 621 and selectively pulling it through the outer shirt neck opening 12 or one of its laterally opposed sleeves 13 (such as shown in FIGS. 1A-B). Alternatively, a user may remove an undergarment by first separating the first and second back panel segments 621E and 621F, such as by undoing or releasing fastener 646, pulling outwardly on a first long sleeve (e.g., 623*a* or 623*b*) to position the respective undershirt first sleeve or second sleeve proximal opening 624*a* or 624*b* (arm receiving opening) adjacent to their elbow, withdrawing the elbow, forearm, and hand out of the first sleeve, and pulling it through the outer shirt neck opening 12. The process may be repeated for the second sleeve, or the second sleeve may be removed through one of the outer shirt laterally opposed sleeves 13. as described below.

Figure 40:
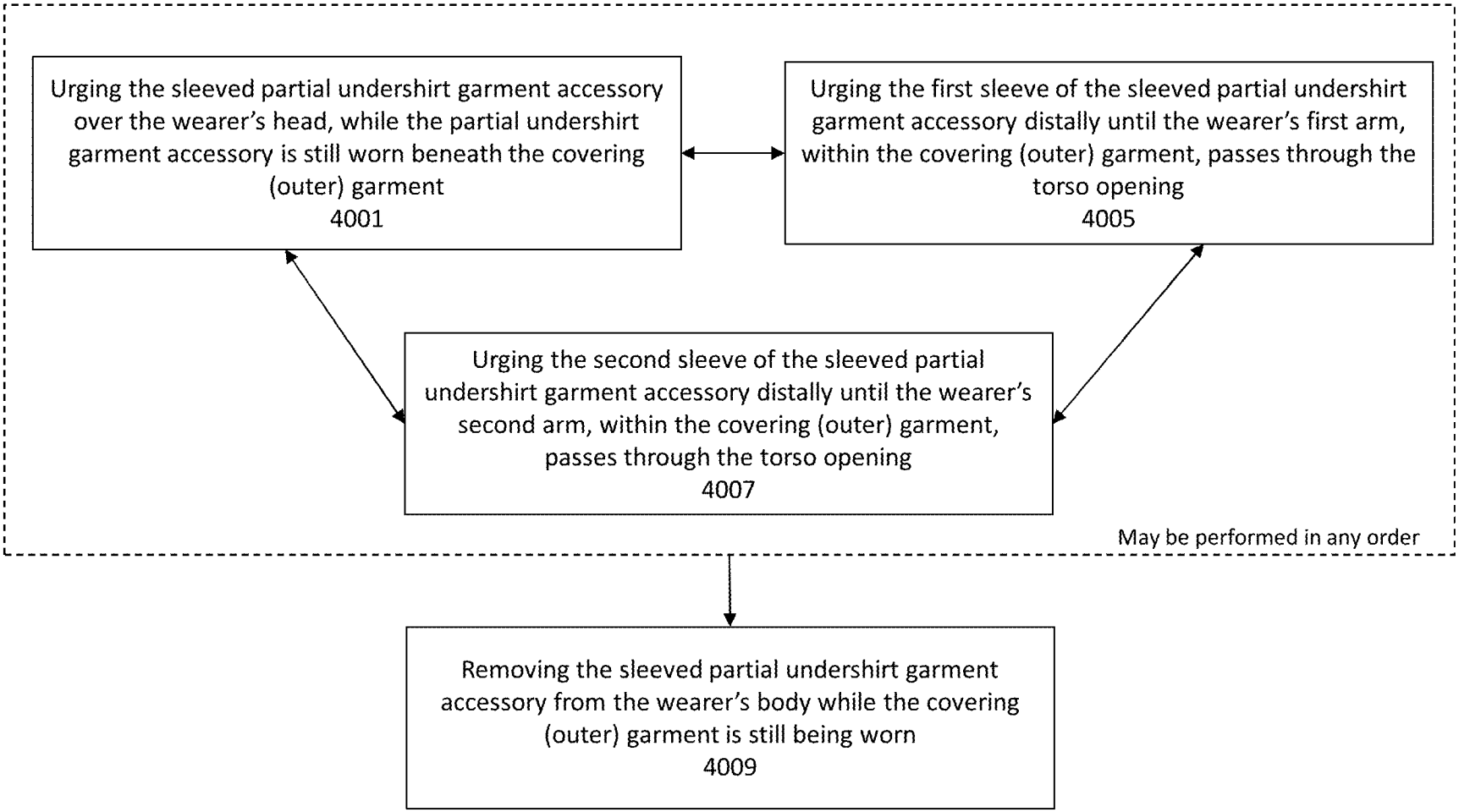
FIG. 40 schematically illustrate a method of removing any of the sleeved partial undershirt garment accessory described herein while an outer garment (e.g., shirt, jacket, etc.) is worn over the sleeved partial undershirt garment accessory.

For example, FIG. 40 illustrates methods of removing a sleeved partial undershirt garment accessory while an outer (covering) garment such as a shirt or the like is worn overtop of the sleeved partial undershirt garment accessory. For example, as shown in FIG. 40, any of the sleeved partial undershirt garment accessories described herein may be worn beneath a shirt (e.g., short-sleeve shirt, long-sleeve shirt, sweatshirt, sweater, jacket, T-shirt, tank top etc.). This covering shirt (over the sleeved partial undershirt garment accessory) is referred to in FIG. 40 as an outer or covering garment. While still wearing the outer garment, steps 4001, 4005 or 4007 may be performed in any order, and then the sleeved partial undershirt garment accessory may be removed from the body while still wearing the outer garment. For example, in a preferred embodiment, the sleeved partial undershirt garment accessory may first be urged over the wearer's head without removing the outer garment 4001. This may be possible because of the relatively short torso region of the sleeved partial undershirt garment accessory, and the stretchability of the sleeved partial undershirt garment accessory. Thereafter, a first sleeve of the sleeved partial undershirt garment accessory may be urged distally, e.g., by pulling on the distal cuff region of the first sleeve of the sleeved partial undershirt garment accessory, until the wearer's elbow passes into the torso opening. This step is also performed while the wearer is still wearing the outer garment. Once the wearers elbow is passed into the torso opening, the wearer's arm may be passed through the torso opening (e.g., by bending the arm at the elbow and drawing the arm proximally towards the torso while holding, or pulling, the sleeve region of the first sleeve) 4005. The second sleeve of the sleeved partial undershirt garment accessory may also be similarly removed while the wearer is still wearing the garment 4007, again by pulling the second sleeve of the sleeved partial undershirt garment accessory distally (or merely applying tension to it by holding it distally) and bending the elbow to pass the elbow, and eventually the entire arm, through the torso opening. Thereafter, the garment may be removed from the wearer's body 4009, for example, by pulling the garment from one of the openings (e.g., a sleeve opening, the torso opening or the neck opening.

Alternatively, long-sleeved partial undershirt garment accessory 620 can be easily removed without having to remove an outer shirt 11 (e.g., an outer short-sleeve shirt) by first separating the first and second back panel segments 621E and 621F, such as by undoing or releasing fastener 646. A wearer may pull outwardly on a first long sleeve (e.g., 623*a* or 623*b*) and pull the sleeve through one of the outer shirt laterally opposed sleeves 13.

Figure 9A:
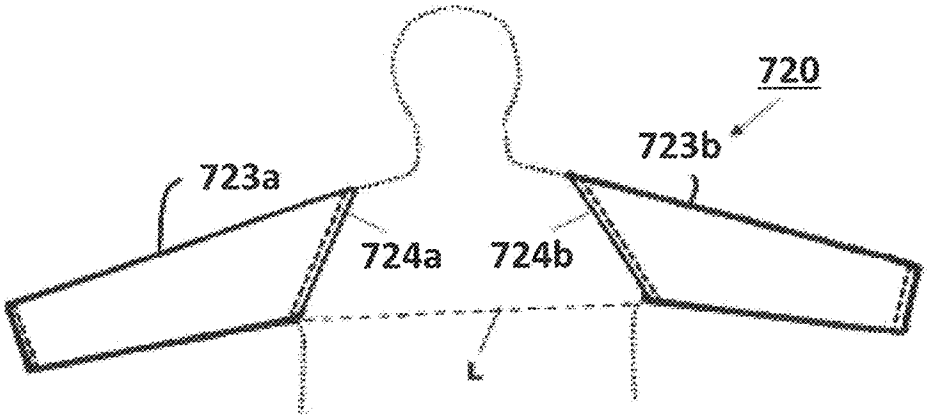
FIGS. 9A and 9B show front and back views, respectively, of a long-sleeved partial undershirt garment accessory having an open front.
Figure 9B:
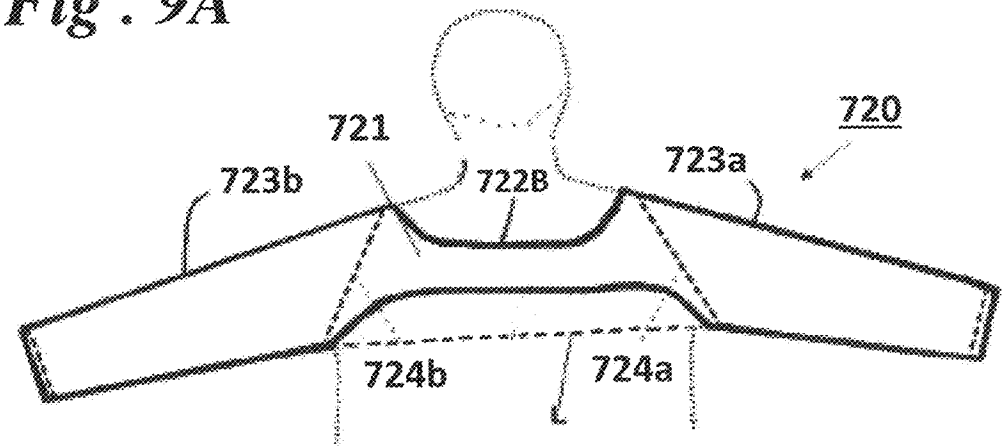

FIG. 9A shows a front view and FIG. 9B show a back view of a long-sleeve undergarment 820 with an open front. Yoke 721 has only a single back region 721B adjoined to the first and second sleeves 723*a*, 723*b* that extends across the back of the wearer's upper torso. above the imaginary line L encircling the upper chest at the underarm area of the wearer. The single rear panel 721B is has a wide low-cut neck opening in this view, but in other examples, could have any shape or configuration. Long-sleeved undergarment 720 can be easily removed without having to remove an outer shirt (e.g., an outer short-sleeve shirt) by the wearer pulling outwardly on a first long sleeve (e.g., 723*a* or 723*b*) to position the respective undershirt first sleeve or second sleeve proximal opening 724*a* or 724*b* (arm receiving opening) adjacent to their elbow, withdrawing the elbow, forearm, and hand out of the first sleeve, repeating this process for the second sleeve and arm, then gripping yoke 721 and selectively pulling it through the outer shirt neck opening 12 or one of its laterally opposed sleeves 13 (such as shown in FIGS. 1A-B).

Figure 10:
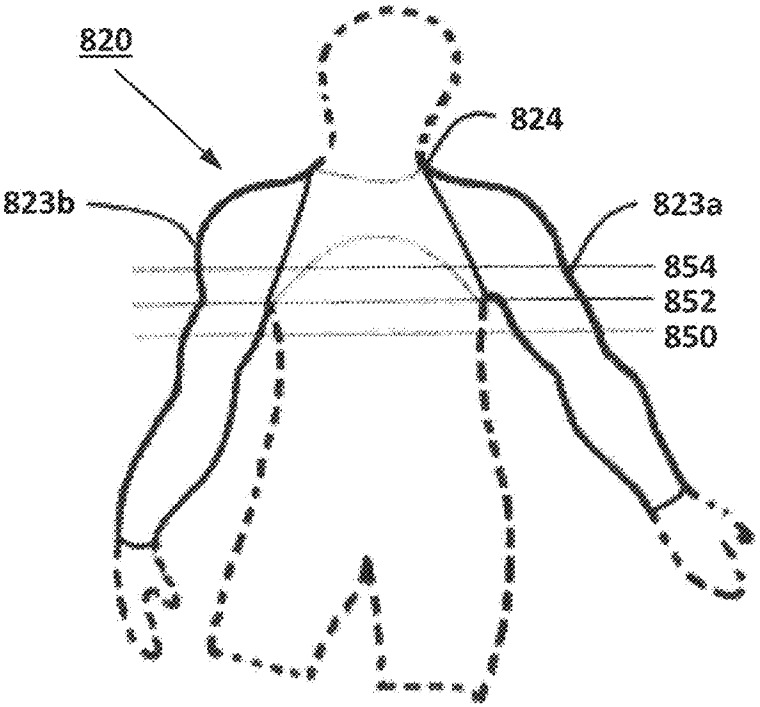
FIG. 10 illustrates examples of how far a sleeved partial undershirt garment accessory may extend along a torso when in place on a wearer.
Figure 11:
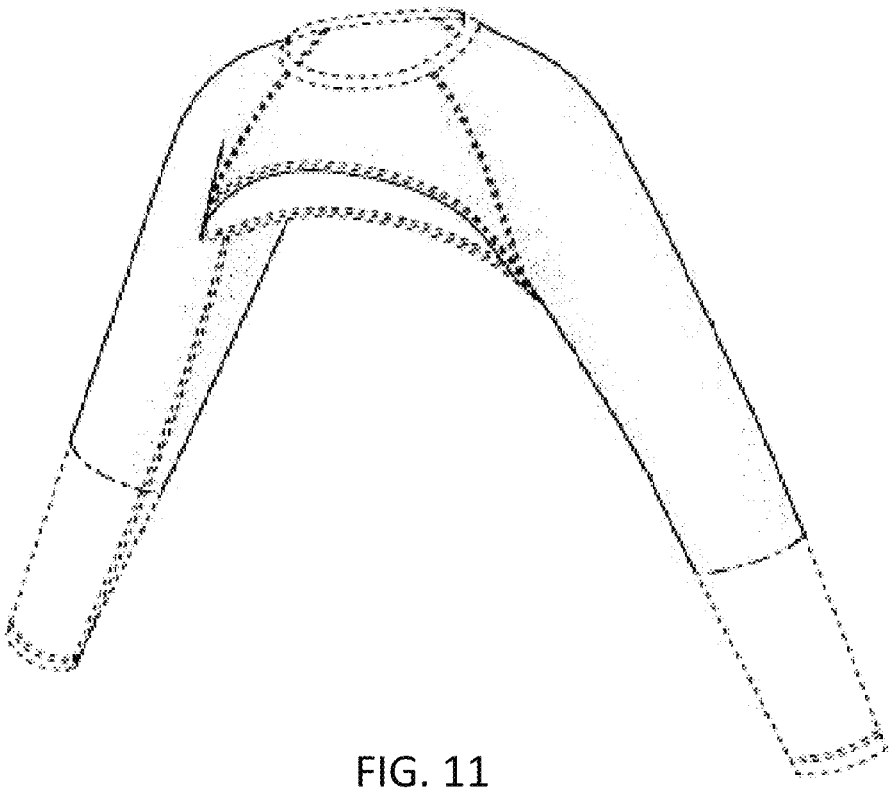
FIGS. 11-17 show side perspective, front, back, right, left, top and bottom views, respectively, of one variation of a sleeved partial undershirt garment accessory having an arched torso perimeter around the torso opening.
Figure 12:
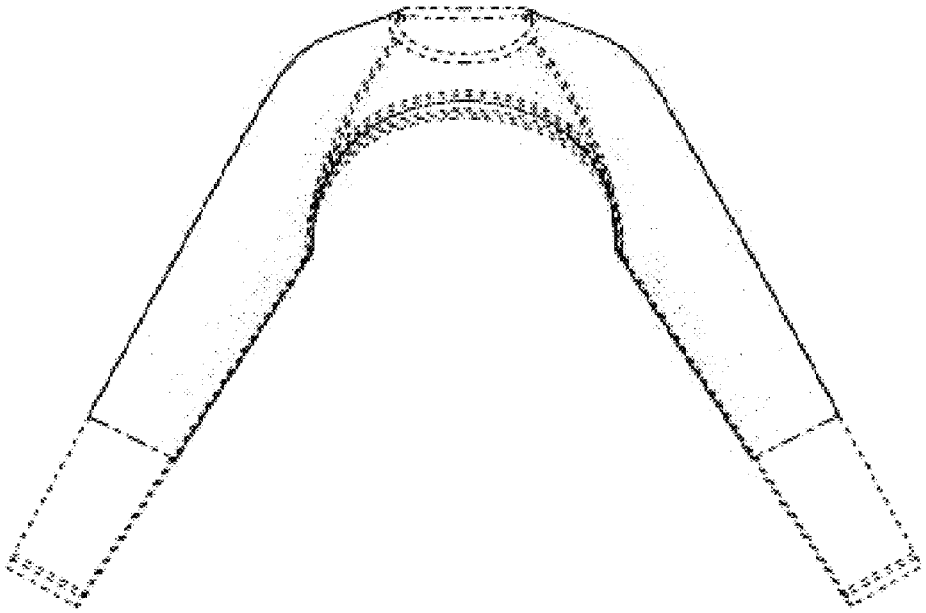
Figure 13:
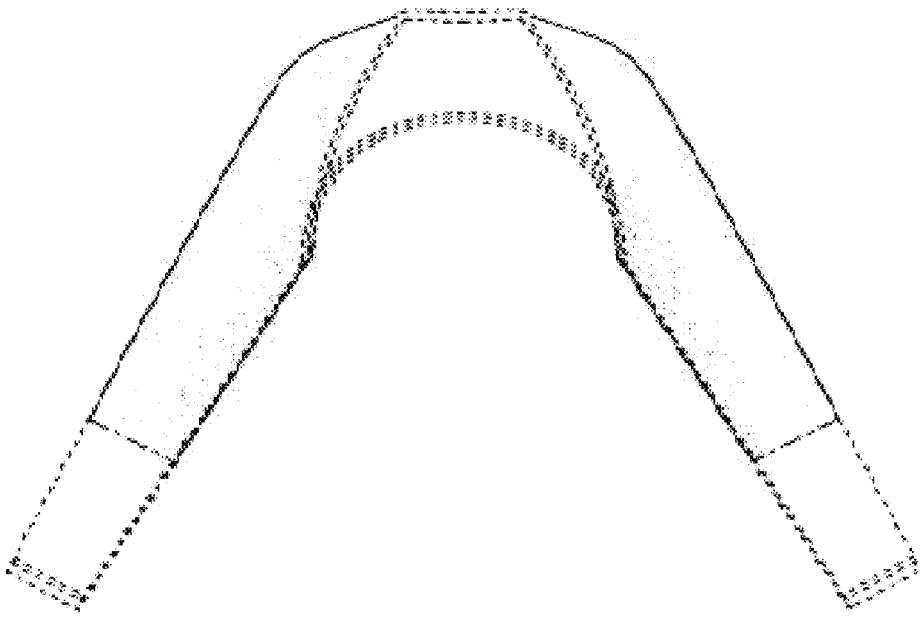
Figure 14:
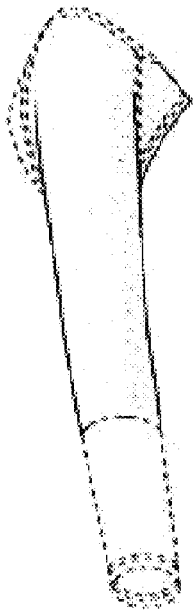
Figure 15:
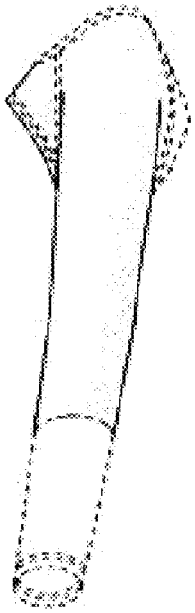
Figure 16:
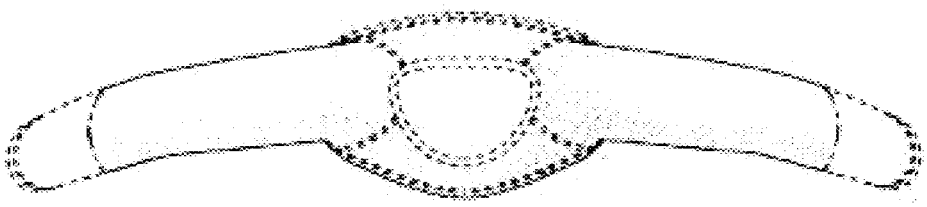
Figure 17:
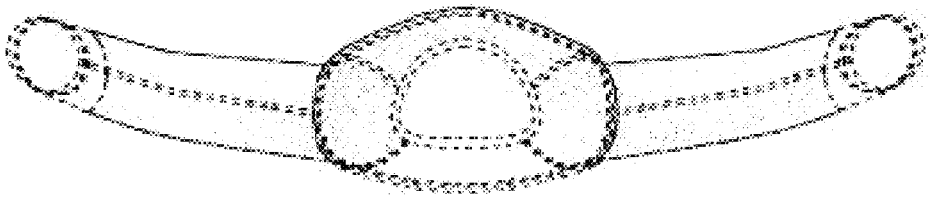
Figure 18:
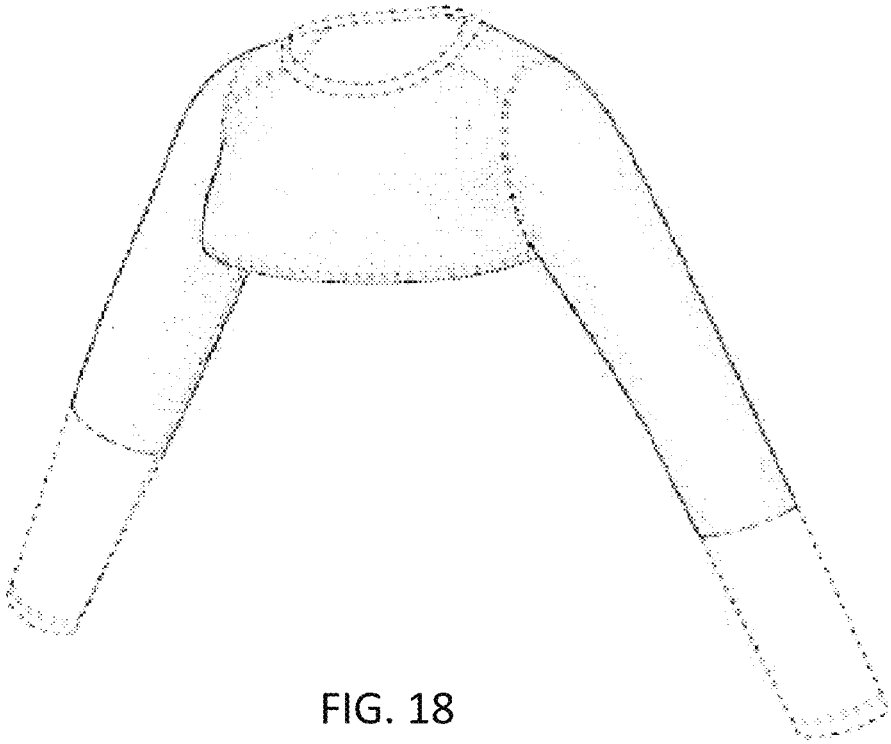
FIGS. 18-24 show side perspective, front, back, right, left, top and bottom views, respectively, of one variation of a sleeved partial undershirt garment accessory having a straight torso perimeter around the torso opening.
Figure 19:
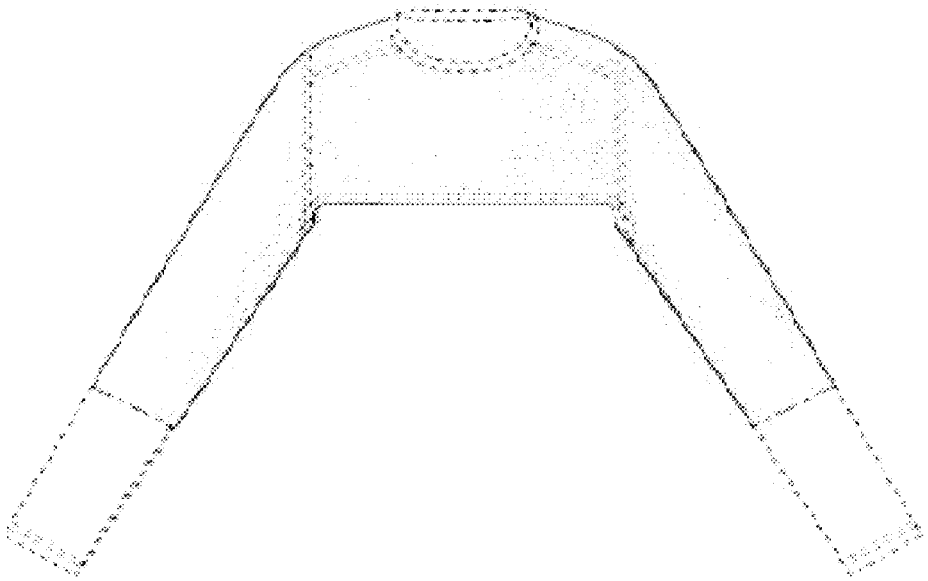
Figure 20:
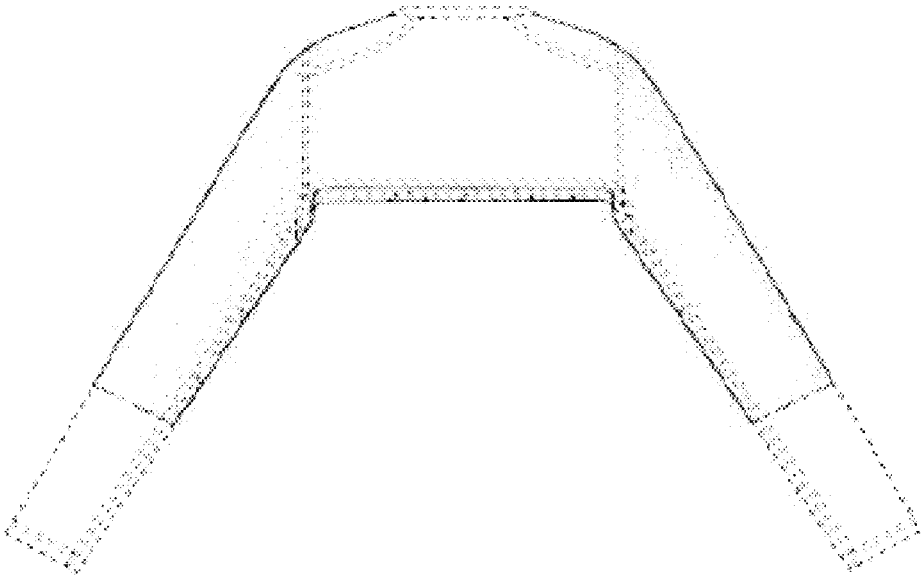
Figure 21:
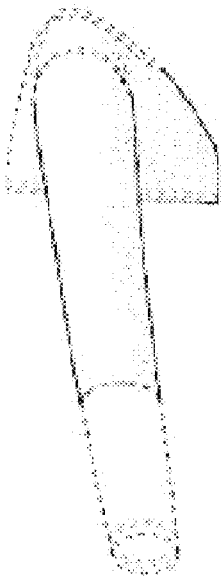
Figure 22:
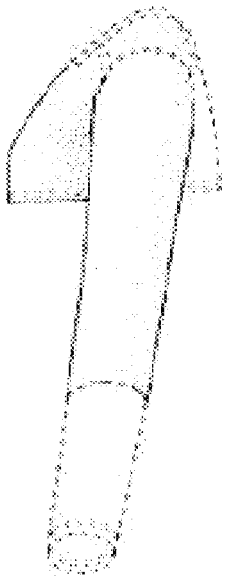
Figure 23:
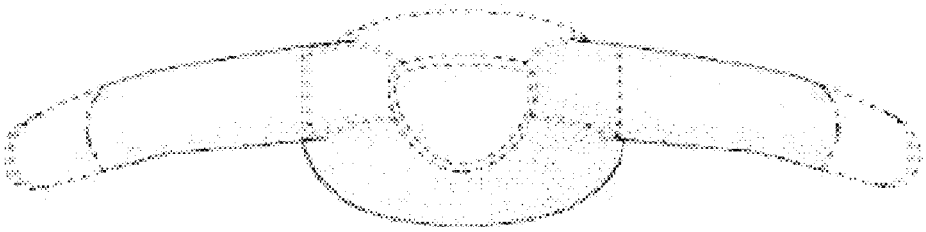
Figure 24:
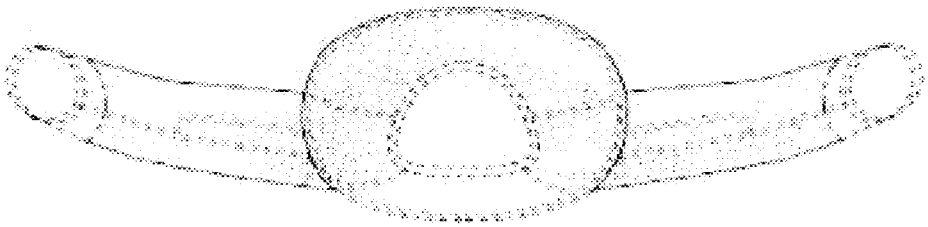
Figure 25:
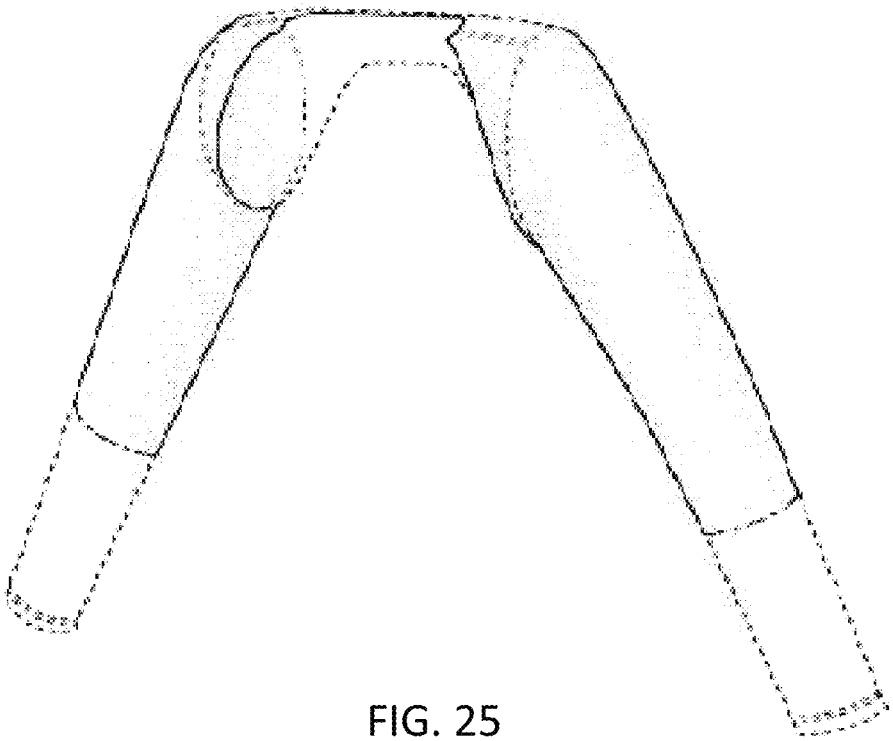
FIGS. 25-31 show side perspective, front, back, right, left, top and bottom views, respectively, of one variation of a sleeved partial undershirt garment accessory having a back and no front region.
Figure 26:
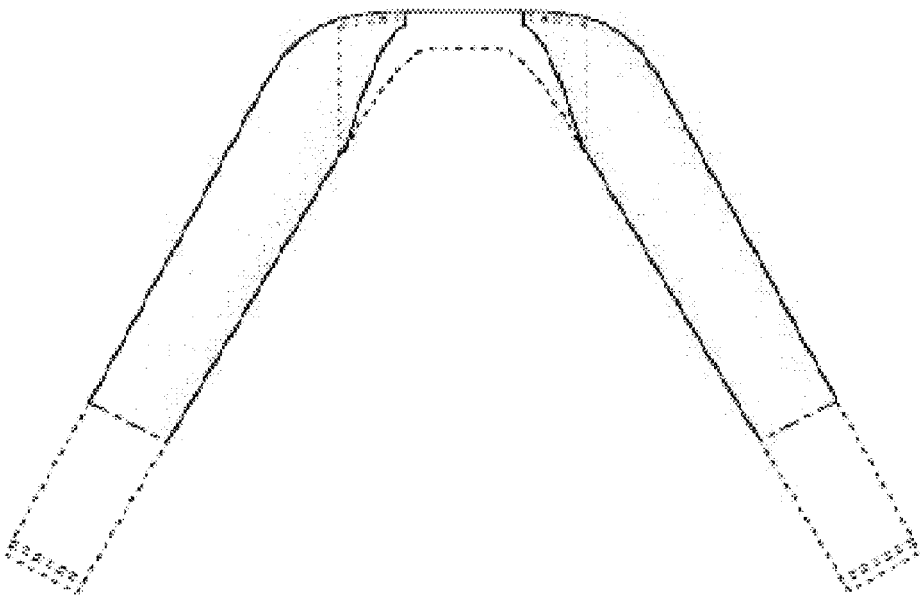
Figure 27:
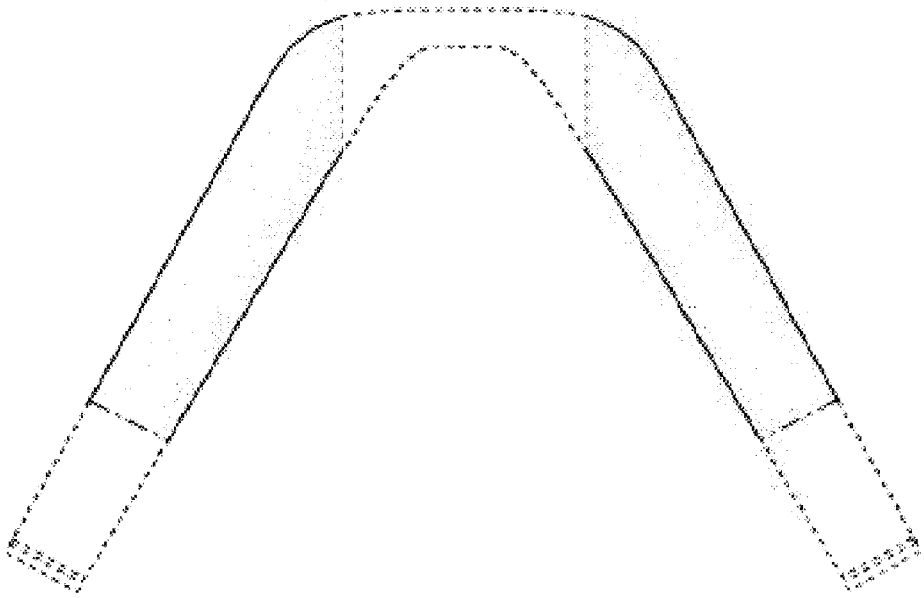
Figure 28:
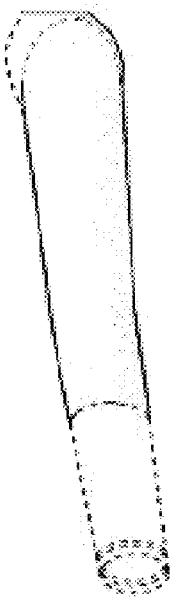
Figure 29:
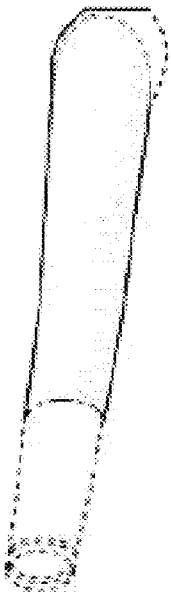
Figure 30:
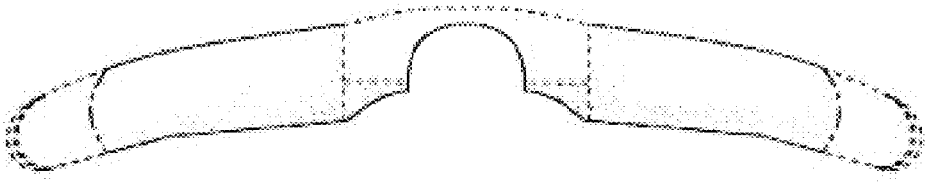
Figure 31:
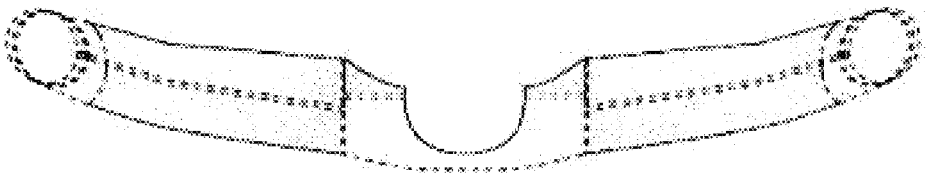

FIG. 10 shows examples of how far a sleeved partial undershirt garment accessory may extend along a torso when in place on a wearer. FIG. 10 shows undershirt 820 with yoke 821 and undershirt first and second sleeves 823*a*, 823*b*. The lateral portion of undershirt 820 and torso opening 834 extends to imaginary armpit line 852 while medial portion of undershirt 820 and the medial portion of torso opening 834 does not even extend as far as imaginary nipple line 854. The bottom-most extent of undershirt 820 may extend as far as or no further than the imaginary abdominal line 850, as far as or no further than the imaginary armpit line 852, or as far as or no further than the imaginary nipple line 854. Armpit line 852 is in the armpit area, generally the region on the human body under the joint where the arm connects to the shoulder. Although shown as an example, any of the undershirt garments described herein or any portions of any of the undergarments may extend as far as or no further any of the above-named landmarks/lines. For example, in some examples, a torso opening extends distally down the first and second sleeves beyond the wearer's armpit regions when the accessory garment is worn.

FIGS. 11-17 show different views of one variation of a sleeved partial undershirt garment accessory with an arched torso region similar to the one shown in FIGS. 5A-5B. In this example, the sleeved partial undershirt garment accessory includes a large torso region that is continuous with the arm openings for each sleeve. The head opening is located opposite the torso opening. The dashed lines indicate a full-length sleeve length configuration and a ¾ sleeve length configuration.

Similarly, FIGS. 18-24 show another variation of a sleeved partial undershirt garment accessory with a straight torso region similar to the one shown in FIGS. 3A-3D. Finally, FIGS. 25-31 show different views of a sleeved partial undershirt garment accessory with a back region but no front region.

As indicated above, a sleeved partial undershirt garment accessory as described herein may be especially useful for allowing the undershirt garment to be easily removed without having to remove an outer garment, such as an outer shirt. A garment as described herein may be a stand-alone garment or may be part of a garment ensemble: a set of two or more garments that are configured to be worn together, forming complementary apparel. Such an ensemble may match or complement each other in some way, such as color, design, fabric, features (such as having complementary button/buttonhole, hooks and loops snaps that mate, match or otherwise fit together between a first and second garment), function, identifying features (e.g., a name, a number, etc.) style, texture, etc. In some examples, a partial undershirt garment may be worn over a second garment, such as over a shirt with sleeves (long, ¾, short), but in generally over a tank top or sleeveless shirt.

Fit

The undershirt garment generally may have a fit described as: loose, fitted, athletic, or compression. By way of example a baseball player may prefer a loose fit leaving breathing room around the arm in the form of a space between arm and sleeve. Athletes may desire a closer fitted or athletic fit, others may like the feel and tight fit of a compression fit sleeve set.

Degree of Body Coverage

A one piece sleeved partial undershirt garment accessory as described herein may not provide significant coverage to the entirety of the torso. Some preferred embodiments provide minimal coverage to the front or back side of the upper torso. Some embodiments do not cover the area below the diaphragm (the large muscle that separates the chest (lungs) from the abdominal cavity (stomach). Some examples of the undergarment described herein may include a collar or neckband and a minimal front fabric member which may extend in the form of an arch from about the lower portion of the proximal arm hole of one sleeve, and form an upward arc across the chest terminating at the other arm hole in a similar manner. The narrowest point in this piece is at the peak of the arc and the collar or neck band. The narrowest point may be near zero allowing the peak to end at the collar. In some embodiments, a garment would have the top of the arch 0-8 inches below the collar, in some other embodiments, a garment may have the top of the arc peak between 1 and 6 inches below the collar forming a nice even arc across the chest of the user generally above the nipples, leaving the remaining area of the front of the torso uncovered by this undergarment. In some embodiments, a garment would have a fabric front forming an arc with a width at the narrowest point from the top of the arc to the neckline of 1.5-4.5 inches. Alternatively a garment may include use only of a yoke which primarily engages only the top of the shoulders and incidentally covers a couple inches of what may be considered the front of the torso, if it covers the front of the torso at all. Alternatively the front section of the undergarment could cross the chest from arm hole area to arm hole area in a straight line manner at or about the bottom of the armpit area, at the nipple line, slightly below the breast muscles, near the base of the sternum, leaving the abdomen uncovered in all cases. In some embodiments, an undergarment covers only the upper region of the chest in an arced manner leaving the breast area uncovered and unsupported. In some examples, the width of this front section of the garment as measured from top of the shoulders to the lower end of the proximal arm hole where the fabric panel is interconnected with the sleeves is about 5 to 9 inches depending on the size of the individual user the garment is sized for.

An undergarment as described herein may only covers the uppermost few inches of the back of the user. By way of example the back side fabric may form an arc with lower ends at or near the armpits and a peak of an arc near the neckline. This back of undergarment section may follow similar dimensions described for the front section. Alternatively a rear section may cross the back in a substantially straight line without a substantial intentional arc being formed by the lower edge of the fabric. The rear piece may cover in the upper portion of the back area in a straight line manner at or about the bottom of the armpit area, at the nipple line, slightly below the breast muscles, near the base of the sternum, leaving the rear side of the abdomen uncovered in all cases. The abdomen is the part of the body between the thorax (chest) and pelvis and generally containing the digestive organs. Some embodiments may have 70% of the front of the torso uncovered and >50% of the back of the torso uncovered.

Sleeves

In some examples, the sleeves are long sleeves. In some examples, the sleeves may fit closely to the body and may be not require (or include) any elastic bands or cuffs. The sleeves are supported by hanging from the top portion and thus are secured on the body and not a source of distraction to an athlete or other user. The sleeves may be of any suitable length. The sleeves may include an aperture for allowing a thumb to fit through. The sleeves may include a pocket for retaining small devices or items. A pocket may be convertible to a pouch for carrying the single piece sleeved torso-less undergarment. In some examples, the sleeves may have no required attachment to an outer shirt and may thus be easily useable with any outer shirt of the user's choice, both of new stock or existing in the user's wardrobe. Sleeves could include cuffs, elastic bands, slits, or pads if required for the application. In some embodiments, the sleeves are un-attached to any torso section of the garment at the very lowest point on the arm hole area of the proximal end of the sleeves, allowing for ease of removal of the arm, via elbow first. Alternatively, the materials and geometry of the minimally torso covering section to be such that the arm hole is easily urge by the user away from the body to allow an arm to be removed.

In general, any of the garments described herein may include a pouch or a pocket. The pocket or pouch may be sewn or otherwise affixed to the garment. The pocket may be located on a sleeve or in the shoulder or torso region. The pocket may be used to carry an identification card, credit card, cash, keys, small electronics and the like. The garment may be tucked into the pocket for ease of carrying or storing the garment.

Fabrics/Materials

Generally lightweight fabric materials would be suitable for the garment for active outdoor types—when hiking, riding, climbing, taking training runs, or gym workouts. Generally, the fabric used is self-wicking. A high-humidity "microclimate" is created between the person's sweating skin and the garment covering the skin. Perspiration vapor and moisture condense on the garment's interior side. Because nature moves toward equilibrium, the high-humidity air mass between skin and garment will seek a path to a lower-humidity environment. The difference (gradient) between temperature and humidity on both sides of the garment becomes the driving force that moves the warmer, wetter air beneath the garment toward the cooler, dryer air on the outside. Wicking takes place when perspiration moisture travels along the surface of the fiber but is not absorbed into the fiber. (Synthetic fibers are, essentially, plastic—and may be nonabsorbent). Moisture escapes to the outside through the interstitial spaces (the minuscule holes) between the knitted yarns. Moisture is dispersed across the fabric's exterior, where it evaporates after contacting the lower-humidity environment outside the shirt. One particular embodiment of the undergarment described herein uses a synthetic fabric which is self-wicking, (i.e. moisture-wicking) light weight, stretchable, feels soft against skin, and is moisture-wicking. Fabrics could be organic such as cotton, or a cotton synthetic blends, however in some particular embodiments fabrics for the garment system described herein are synthetic microfibers, polyester, spandex or nylon blends, rayon, etc. An undergarment as described herein may be thick or thin, and may be void or have minimal bulk or folds. It may be configured to lie flatly against the body. In some particular embodiments, a fabric is a comfortable four-way stretch microfiber fabrics that can move easily with the body, breathe well, are lightweight, and readily move sweat away from the body and to the outer fabric/garment surface, where it evaporates to keeps the user cool, dry and comfortable. By way of example: light to medium weight (2-8 oz.) breathable fabrics of polyester, spandex or nylon blends, designed to move with the body rather than to cling to body, may be used. For example Dri-FIT™ family garment and fabrics by Nike™ are generally suitable for the garments described herein. Preferred fabrics are very soft, lightweight made with different knit patterns. An open or mesh pattern could be used in areas of high sweat or where increased breathability is desired, such as under the arms. Strategically placed ventilations zones may be incorporated into the garment to allow air to flow and cool the body. A fabric for an undergarment may be any weight. For example a fabric (Oz./Sq. Yd./Grams/Sq. Mtr.) may be ultra lightweight (2-4 oz./68-136 gr.), light (4-6 oz./136-204 gr.), medium (6-8 oz./204-272 gr), medium heavy (8-10 oz./272-339 gr.), heavy (10-12 oz./339-407 gr.) or extra heavy (12-14 oz/407-475 gr.). A fabric weigh may, for example, 2-6 oz. for warmer weather, and 4-10 oz. for moderate activity in cool weather and 6-14 oz. for low activity or cold weather use. A fabric for a garment described herein may include an ultraviolet (UV) treatment or characteristic allowing the user to avoid or minimize the use of UV blocking lotions. By way of example, the garment may have a UPF ultraviolet protection of greater than 20, 40, 30, or 50, etc.

An exemplary embodiment of a sleeved partial undershirt garment accessory as described herein for hot weather may include: Ultra-light and smooth fabrics with strategically positioned mesh panels to help regulate heat and allow sweat to evaporate faster; a smooth flat seam which does not restrict range of motion; long sleeves which extend further down the arm further than any outer sleeves of an outer garment worn over the undergarment.

The sleeves for a sleeved partial undershirt garment accessory as described herein may be any length as described herein, but in some particular examples may be (at least) three-quarter or bracelet length (e.g., extends approximately three-quarter the distance that of a long sleeve (which is a sleeve that extends to the wrist area) or pass the elbow but not to the wrist).

The sleeves could be made in any suitable fit, such as Compression, Fitted, Semi-Fitted, or Loose (such as interpreted by comparison to products by Under Armour™). Some embodiments may include a stretchable microfiber of 2-6 oz. construction with long sleeves and a fitted or semi-fitted fit. Another embodiment of a garment as described herein includes a compression material or a compression fit configured to increase muscle power through an ultra-tight fit. Some garments as described herein may fit like a "second skin", tightly following the contour of the body while providing benefits of compression technology. A garment as described herein may include mesh panels and flat seams to fit smoothly to the body for a close and comfortable fit. In some examples, a garment may be made of 50-100% recycled polyester and may be constructed with flat-seams. Other embodiments may include, for example, a synthetic/organic fiber mix by way of example a 85% polyester/15% cotton blend.

In some examples, the garment includes a torso section with a first opening for receiving a head and neck of a user and a second opening for receiving the torso. A first opening could include a neck band made of elastic material, and may extend up the neck any suitable distance. A torso section may also include a pair of opposed openings for attachment of a pair of opposed sleeves which may be attached (e.g., sewn or stitched) to the torso section completely around the perimeter of the arm holes, similar to a traditional shirt design. In some examples, the torso section of the garment does not include side seams which typically would extend from an armpit region toward the waistline. In some examples, a torso section may terminate at or near the armpits and may not extend down the torso below the arm pits. Such an embodiment would leave a portion of the armpit of the user exposed (e.g., by the undergarment) with regards to the torso section of the garment. Sleeves of such a garment may be open along a portion of the armpit which extends under the arms. This open area improves air circulation and helps to enable selective delayering of the body by removal of the present inventive garment whilst an outer garment is being worn. In some other examples, a torso section does extend along the torso from the arm pit towards the waistline, but terminates at an imaginary line at the sternum elevation of the body. In some embodiments of an undergarment as described herein, a portion of a perimeter of a torso opening is shared with all of a portion of the arm hole opening, allowing a user to easily de-layer the arms while wearing an outer garment. A perimeter may be continuous between a torso (or torso opening), a first sleeve (or first sleeve opening) and a second sleeve (or a second sleeve opening).

Construction

A garment as described herein may be made in any way, such as ready-made in a factory or in bulk by such techniques common to the manufacture of T-shirts, athletic apparel, etc. In some examples, the garment is void of fasteners, and void of elastic bands around the arms. Sleeves may be tubular and attached to a yoke or a center piece by any means such as sewing or stitching. The sleeves could alternatively be connected directly to each other across the torso section in any manner. A connection could be strip of fabric which only extends across the upper back of the user, only across the front of a user or both. The sleeves could connect to a collar or neckband. The connection of the sleeves to each other or to the yoke, collar or center section could be by a detachable means such as the use of fasteners but in general will not use such a fastener. A collar or neckband may include an opening and fastener system to allow selective opening or to disconnect the collar at a single or multiple points. The fabric and construction of the garment in generally allows for a wearer's elbow to be easily slipped out of the arm hole thus enabling easy removal while an outer shirt is being worn. This may require selective use of elastic materials, mesh fabrics or increased stretch materials and suitable geometries.

Use

Layering clothing is a tried-and-true way to maximize a person's comfort, particularly when the person is outdoors or when the person's activity level changes. The beauty of this simple concept is that it allows a person to make quick adjustments based on your activity level and changes in the weather. Layering is system and method of applying garments to the body, generally to improve comfort to the user. Garment layers may be classified by their relative position to the skin surface and to that of other garments, as well as to the function they are intended to perform. Each layer has a function. For example, a base layer is the next-to-skin layer. A base layer may help regulate body temperature by moving perspiration away from a wearer's skin and managing moisture. A base layer can be, for example, briefs, sports bras, long underwear sets (tops and bottoms), tights, T-shirts, underwear, etc. It can be designed to fit snugly or loosely. Materials weights and types may be chosen to best match an activity and temperature. An insulating layer may help retain heat by trapping air close to a person's body to protect them from the cold. An insulating layer is often worn over a base layer. An outer (or shell) layer is a layer applied over an insulating and/or base layer and may shield the user from elements such as wind and rain. Layers are simply added or subtracted as desired, and not all layers are necessarily worn. A garment as described herein may provide a user new options in "layering" and a user may (e.g., selectively) add coverage to the arms without adding an additional layer of clothing to the abdomen (or other regions of the body, such as the lower torso, the upper torso, the chest, the back, etc.) and without substantially restricting heat flow from the torso region. A garment as described herein may allow a user to add a one-piece torso-less, ¾ or long sleeved, fabric constructed garment which may be void of fasteners or other skin irritating elements, to protect his arms, without requiring an additional layer over the majority of the torso. A garment as described herein may allow a user to carry a small light weight one-piece interconnected sleeve set, such as in some examples made of a light weight synthetic fabric (such as Dry-Fit™ owned by Nike) or a 4.7 oz. Polyester/Elastane material. An undergarment as described herein may be thick or thin, and may be void or have minimal bulk or folds. It may be configured to lie flatly against the body.

In any of the variations described herein the garment may be all or partially made of a mesh: e.g., 4.4 oz. Polyester, a Lightweight UA Tech™ fabric or a 5.4 oz. Polyester/Elastane. A synthetic fabric with a weight less than 8.0 oz. may be used. A fabric with a weight less than 6 oz. (per sq. yard) may be especially desirable for some applications. Described herein is a new and useful method of de-layering or removing an underlying shirt. A user may wear a sleeved undergarment as described herein in conjunction with an outer shirt. An outer shirt may be sleeved, short sleeved or sleeveless, If it is short sleeved or sleeveless the user may reach up the sleeve of the outer shirt and grab the lower portion of the long-sleeved undergarment such as at or about the lower portion of the arm hole opening and pull or urge it away from the body and in a direction down the arm, the user may then slip his elbow, forearm and hand free from the sleeve of the undergarment while the outer garment (e.g. T-shirt, golf shirt, polo, blouse, dress etc.) remains in place. This method can be repeated for the second arm and sleeve. Once the arms are freed from the undershirt may be released from the neck such as by opening a collar (for some examples if a collar that opens and a fastener are provided) or may simply be slipped over the head to free (remove) the undershirt from the body. The undergarment can then be pulled free from under the outer garment through any of the openings in the outer garment (e.g. neck hole or arm holes). This de-layering may be particularly useful to athletes who, for example, may begin a workout or competition early in the morning when temperatures are relatively lower and before excessive body heat is being created. After a short period (e.g., a few minutes, up to 10, 15, 20, 30, 60, etc. minutes) of heavy activity the need for sleeved coverage of the arms may end. A garment as described herein enables a user to (e.g., selectively) remove the one piece long sleeved undergarment in a matter of seconds, while remaining in a competition, race, exercise, etc. with little to no interruption. A garment may then be easily carried by tying around one's waist, with less bulk and weight than many jackets. A garment as described herein may be easily be carried in a purse, pocket or small pack, and may be easily used and worn when conditions require added warmth or extra protection, such as for example, as evening falls, as one enters an air conditioned environment or when one desires to extend the usefulness of short-sleeved garments but without donning a jacket. A garment as described herein may include a pocket and may be stored in such pocket, forming a pouch.

A sleeved partial undershirt garment accessory as described herein may have any configuration. It may be configured to fit a female, a male, or both (e.g., may be unisex). It may be configured to fit a child, a teenager, or an adult. A sleeved partial undershirt garment accessory generally has one or more sleeves. Although an undershirt will be generally symmetrical (e.g., left side and right side may be more or less mirror images of each other), it may also be asymmetrical (e.g., have only one sleeve, sleeves may be different lengths, front or back panels may be differently shaped etc.).

Sleeves of a sleeved partial undershirt garment accessory (of a garment system) may in general start and extend from a top of a shoulder and may end at any extent (e.g., a sleeve may extend to any length along or just past the end of a wearer's arm). As indicated above, a sleeve may or may not have a seam or other marking to indicate the proximal sleeve location. A first sleeve and a second sleeve may be different lengths, but in general will be the same length. Sleeves of a sleeved partial undershirt garment accessory may be any length, but in general will be configured to extend past the elbow of a wearer when wearing the undershirt garment (e.g., to be at least ¾, or full-length). Thus, sleeves may be at least short-sleeves or longer than short-sleeves, at least elbow length or longer than elbow length, at least ¾ length or longer than ¾ length, at least full-length or longer than full length. A distal end of a sleeve may include additional material at its end, such as a cuff, elongated portion, folded portion, hand covering, etc. and in some examples, such material may further extend past the wrist. Such material may be unfolded or stretched and may fit over a hand or part of a hand of an individual. Such extra material may provide protection or warmth to the hand or part of the hand. In some variations, one or both sleeves of may be closed or closeable and a material may enclose a distal end of a first and/or second sleeve. For example, a sleeve may end in a mitten portion or glove portion. An end (e.g., a closed end) of a sleeve may be integral to, attached to or removably attached (detachable) to an undershirt. For example, a closed end of a sleeve may held to the undershirt by a fastener, such as a button, a hook and eye, hooks and loops, a snap, a zipper, etc. or other fastener as described herein or as known in the art, and the closed end removed. A closed end of a sleeve may be reversibly openable but may remain attached to a sleeve. For example, a closed end may be held closed such as by hooks and loops (e.g., Velcro), etc. and may be opened to allow a hand or finger to be removed from the closed end such as for cooling, to pick something up, to touch a phone, etc. A closed end of a sleeve may have features, such as sticky portions to improve grip, etc.

A sleeve of an sleeved partial undershirt garment accessory may extend distally (e.g., from the top and lateral (outside) part of the shoulder) more than 10 inches, more than 11 inches, more than 12 inches, more than 13 inches, more than 14 inches, more than 15 inches, more than 16 inches, more than 17 inches, more than 18 inches, more than 19 inches, more than 20 inches, more than 21 inches, more than 22 inches, more than 23 inches, more than 24 inches, more than 25 inches, more than 26 inches, more than 27 inches, or more than 28 inches but in general will extend longer than a short sleeve shirt (e.g., will extend more than 16 inches or a comparable distance for a child's shirt). A distance between the distal-most region of the proximal first sleeve opening and an elbow region of the first sleeve may be about or greater than 50%, about or greater than 60%, about or greater than 70%, about or greater than 80%, about or greater than 90%, or about or greater than 100%, about or greater than 110% the distance from the elbow region to a distal end of the first sleeve or between any of these values (e.g., between 60% and 70%, between 60% and 80%, between 70% and 90%, etc.)

In general, any portion of the garments described herein (e.g., an elbow or other areas) could include re-enforcing layers, padding and the like.

An extent of a sleeve may be chosen for any reason, for example, to fit a person's size (e.g., a child may need a shorter sleeve than an adult), for a particular purpose (e.g., a sleeve length of an sleeved partial undershirt garment accessory configured for shoulder and upper arm protection from the sun may be shorter than a sleeve length of a garment configured for protection against cold or insects, etc.). A sleeve of a sleeved partial undershirt garment accessory of a garment system will generally extend further along the arm (e.g., further distally) than does a sleeve (or a sleeveless portion) of an outer shirt garment. A sleeve has a proximal sleeve opening and such a proximal sleeve opening may be continuous with a torso opening or may not be continuous with a torso opening of an undergarment. A torso opening may intersect/be partially shared with/extend (partially) down the sleeve. A torso opening may extend less than 1 inch, from 1 to less than 2 inches, from 2 to less than 3 inches, from 3 to less than 4 inches, from 4 to less than 5 inches, from 5 to less than 7 inches, or less than 10 inches along the sleeve. An opening along a sleeve may generally be a slit, elongated, etc. In other examples, a torso opening may not extend at all along a sleeve opening and may not be connected with the sleeve opening. In some examples, a sleeve of an undergarment may be integral with a yoke (e.g., a front or back region of a yoke) without the use of fasteners, straps or other sleeve attachments of the sleeve to the outer (or under) garment.

A sleeved partial undershirt garment accessory (e.g., a yoke portion) may have any type and any shape of neck portion. A neck portion may be finished (e.g., be turned under) or unfinished, may have a crewneck or a neckband or may not have neckband, may be collarless or may have a collar, may have or may not have a short or a long (full-length) placket, may have no fasteners, or may have a fastener such as buttons, snaps, zippers, etc. A placket is an opening, generally at the neck or sleeve, and may be configured to be left open or two portions of a placket may be fastened together with a fastener, such as a button, a hook and loop, a magnetic closure, a snap, etc. A placket may be added for design, or may aid in allowing the undershirt to be more easily put on or taken off.

In some particular variations, a sleeved partial undershirt garment accessory may include a hood configured to cover a portion of a wearer's head. A hood may be especially useful for providing protection (e.g., from insects, sun, etc.), style, warmth, etc. A hood may be attached to a yoke, such as to a back region and/or a front region or to a collar or may extend from a neck opening of an undershirt. A hood may be continuous with a sleeved partial undershirt garment accessory or may be removably attached (detachable) such as using a fastener such as a button, zipper, etc. as described elsewhere herein or as known in the art. Any of the undershirt garments as described herein may have a feature to aid in undershirt removal or putting on a garment. For example, a sleeved partial undershirt garment accessory may have a loop, a string, a tab (e.g., a pull tab). Such a feature may be on a sleeve, a front region, a back region, etc.

A garment to wear with a sleeved partial undershirt garment accessory such as an outer shirt garment as part of a garment system may have any configuration. It may be configured to fit a female, a male, or both (e.g., unisex). It may be configured to fit a child, a teenager, or an adult. An outer shirt garment may be sleeveless or may have one or more sleeves. Although in general an outer shirt will be generally symmetrical from its first side to its second side, it may also be asymmetrical (e.g., have only one sleeve, have sleeves that are different from each other, taper in one direction, longer along one part, etc.). A sleeveless garment may have a narrow or wide shoulder strap(s), and may be for example, an athletic top, a camisole, a halter, a muscle shirt, a swim suit top, a swim suit, a tank top, a vest, etc. In some particular examples, an outer shirt may be a short sleeve shirt and have sleeve that covers the upper arm and extending from the shoulder to the elbow or above the elbow. In some other particular examples, an outer shirt may be a T-shirt (also known as a tee-shirt or tee): a style of shirt, named after the T shape of the body and sleeves that is normally associated with short sleeves, a round neck line known as a "crew neck", and no collar. Such short-sleeve shirts and T-shirts are commonly worn, especially by people who are active, and may be especially useful with the undershirt garments described herein. Such shirts are generally a pullover shirt without a collar or buttons, and commonly formed by stitching (e.g. sewing together) a stretchy, finely knit or finely woven fabric (e.g., may be made with small denier fibers such as small denier cotton or microfibers). A T-shirt may be void of snaps, buckles, fasteners, straps of zippers or the like.

A sleeve of an outer shirt garment (of a garment system) may in general start and extend from a top and lateral (outside) of a shoulder and may end at any extent (e.g., a sleeve may extend to any length along or just past the end of a wearer's arm). As indicated above, a shirt may or may not have a seam or other marking to indicate the proximal sleeve location (e.g., the proximal start of the sleeve). An outer shirt garment however most commonly has a sleeve that is elbow length or shorter than elbow length (e.g., is short-sleeved or shorter) or is sleeveless (lacking a sleeve). A sleeve of an outer shirt garment may be cap sleeves or shorter or longer than cap sleeves, short-sleeves or shorter than or longer than short-sleeves, elbow length or longer or shorter than elbow length, bracelet or ¾ length or longer or shorter than bracelet or ¾ length. In some instances, sleeves of an outer shirt garment may even be full-length or longer but in general will be shorter than elbow length. A sleeve of an outer shirt garment may extend distally (e.g., from the top and lateral (outside) part of the shoulder) approximately or less than 16 inches, approximately or less than 17 inches, approximately or less than 18 inches, approximately or less than 19 inches, approximately or less than 20 inches, approximately or less than 21 inches, approximately or less than 22 inches, or approximately or less than 23 inches.

An outer garment may have any type and any shape of neck portion. A neck portion may be finished (e.g., be turned under) or unfinished, may have a neckband or no neckband, may be collarless or may have a collar, may have a crew-neck, have no, a short, or a long (full-length) placket, may have no fasteners, or may have fasteners such as buttons, snaps, zippers, may be high-cut or low-cut, etc. A collar or other attachment may extend from a neck opening.

A garment as described herein (e.g., a sleeved partial undershirt garment accessory or an outer shirt) may be made of any material, but is generally stretchable or stretchy, e.g., is made from a stretchy fabric. Such a fabric may be especially useful for using the garments described herein for active or athletic purposes as they can easily stretch to be put on and taken off and during use. A garment as described herein may be made of material that is washable and easy to clean. A garment as described herein may be or have a full fit, or a loose fit for enhanced range of motion and breathable comfort. A full-fit or loose fit garment may be especially useful for an outer garment.

A garment as described herein (e.g., a sleeved partial undershirt garment accessory) may be configured to be comfortable while being removed or put on. A sleeved partial undershirt garment accessory as described herein may be worn over another garment or under another garment and may be near (against the skin) or may be the outermost garment being worn. A garment as described herein (e.g., a sleeved partial undershirt garment accessory) may be configured to minimize or optimize the extent to which a wearer may need to change, contort, rotate, twist, etc. a part of his body, such as an arm, an elbow, a finger, a hand, a neck, a shoulder, etc. to put on or remove a garment. A garment as described herein (e.g., a sleeved partial undershirt garment accessory) may have any size torso opening that accommodates a user's body and allows the undershirt to fit under the outer garment, but in general will have a torso opening slightly smaller (e.g., if material is stretchy) the same size, or slightly larger (e.g., up to 1 inch, up to 2 inches, up to 3 inches, up to 4 inches larger in diameter than a user's torso). As indicated above, a torso opening is continuous with an arm opening. In some examples, a distal-most portion of a sleeve opening may lie at the bottom of the sleeve opening. In some examples, a distal-most region of the sleeve opening may not lie at the bottom of the opening. A distal-most region of the sleeve may lie elsewhere than at the bottom of the opening. For example, it may lie at a position intermediate between the top and the bottom of the sleeve opening. It may still, however, be continuous with the torso opening. In some other examples, the distal-most region of the proximal first sleeve opening is on a back region of the first sleeve and a distal-most region of second sleeve opening is on a back region of second sleeve. Such locations may aid in removing the arm or part of arm from the garment. A garment as described herein (e.g., a sleeved partial undershirt garment accessory) may be configured such that an elbow (and arm) may be removed while bending an elbow less than 15°, less than 30°, less than 45°, less than 60°, less than 90°, or less than 120° or between any of these amounts (such as between 30° and 60°. For example, a shirt with a torso opening as described herein may be configured such that an elbow (and arm) may be removed while rotating a shoulder less than 70°, less than 60°, less than 50°, less than 40°, less than 30°, less than 20°, or less than 10° or in between any of these amounts. A sleeve or torso or portion or a sleeve or torso of an undershirt may be stretchy or otherwise configured to twist or rotate (relative to another portion of the sleeve or torso or to the arm or torso of a wearer) to aid in putting a garment on or removing a garment). For example a sleeve or torso or portion or a sleeve or torso of an undershirt may be configured to twist or rotate more than 180°, more than 120°, more than 90°, more than 60°, more than 30°, or more than 10° (or in between any of these amounts). For example, one undergarment may be less stretchy but have a larger torso opening while a similarly sized garment may be more stretchy, but have a smaller torso opening. A front region of an undershirt may have any shape, such as those described herein. It may have straight lines, may be curved (e.g., convex, concave), may be generally rectangular, regular shaped, irregularly shaped, etc. In some examples, a portion of the front region of an undershirt as described herein bounded by the torso opening extending between first and second sleeves is curved towards the neck opening, exposing the pectoral region of the wearer. In some other examples, a portion of a back region of a sleeved partial undershirt garment accessory bounded by a torso opening extending between first and second sleeves is curved towards the neck opening.

A material for use in a garment such as described herein may be chosen for any desired quality, such as breathability, chlorine resistance, compressibility, freedom of movement, shape recoverability, stretchability, tightness, water resistance or water proof quality, weather resistance, weight, wind resistance, etc. A fabric may be any, such as a 2-way stretch fabric configured to stretch in one direction, a 4-way stretch fabric configured to stretch crosswise and lengthwise, etc. A fabric may include more than one type of material or elements as described herein. Non-limiting examples of fabric or materials useful for the garments described herein include ClimaLite®, jersey, knit fabric, mesh, microfiber, spandex (e.g., elastane, Lycra®), stretch poplin, stretch satin, and cotton, other polyester and polyester blends having small amounts of spandex or other elastic elements, etc.

Described herein is undergarment of self-supported sleeves which may be conveniently worn in conjunction with short-sleeved outerwear. An undergarment as described herein may include a pair of sleeves connected to each other across the shoulder or upper torso area of the body, without providing substantial covering to the back or torso. An undergarment as described herein may lack the majority of the covering of the torso in the front or back side of the user. In some examples, an undergarment provides no coverage to the front of the torso from a point on the torso located between the shoulders and breast line of the body. In some examples, the garment covers the front of the torso only above an imaginary line which encircles the body at the armpit level. In some examples, the abdomen of the user is completely uncovered by an undergarment. Some examples provide a convenient means of extending single layer coverage of the torso and upper body, such as that provided from a conventional short-sleeved apparel (such as a T-Shirt) to conveniently include (and/or remove) coverage of the arms. In some examples, the undergarment is a one piece garment and described herein is a method for easily removing the undergarment without requiring the user to remove the outer garment layer.

A self-supporting garment as described herein may but generally does not require fastening to the outer garment, or elastic attachment to the body. The self-supporting nature of the sleeves may be void of requiring fastening to the outer garment, use of fasteners or elastic attachment to the body. The sleeves are generally supported via hanging from the shoulder region thus not requiring tight or compression fit, or the use of elastic bands on the arms. The sleeves are interconnected across the torso in the shoulder region which holds them on the body, and holds the sleeves securely in place. In some examples, the sleeves are attached to a collar or neck band. Preferably construction of the garment allows the lower portion of the arm holes of the proximal end of the sleeves to be urged away from the body by a user pulling on the sleeves, such that an elbow, forearm and hand can be removed from a sleeve. This process can then be repeated for the other sleeve, such that the garment can then be released from the neck and pulled over or otherwise free from the head and removed from use, and all of this while an outer-shirt is being worn. The garment system may provide the appearance of a much warmer multi-layered shirt, or double shirt arrangement, but may not have the disadvantage of a heat retaining double layers on the torso and upper body, while retaining the ability of the user to easily shed coverage of the arms as conditions change. The short sleeves of the outer garment provides coverage of the upper most portions of the sleeves, providing the fashionable appearance to an observer of a two layers of shirts, or a short sleeve shirt with fastened and potentially detachable sleeve extensions. The undershirt may be applied and worn on the body in a similar manner to a conventional shirt. In one example, the garment is a one piece garment and method for using the garment includes for easy removal without requiring the user to remove the outer garment layer.

A sleeved partial undershirt garment accessory may have a central yoke portion that fits around the neck and over the shoulders of a wearer to form a neck opening for receiving the head and neck of the wearer, and a pair of sleeves, each having an arm receiving opening at a proximal end adjoined to laterally opposed ends of the yoke portion, and each configured to extend from the wearer's shoulder to their wrist. A long-sleeve undergarment may be devoid of any fabric or panels that cover the front or back of the wearer's torso below an imaginary line encircling the upper chest at the underarm area of the wearer. In some embodiments, an undergarment may have panels in the front, back or both but when provided they do not extend below an imaginary line encircling the upper chest at the underarm area of the wearer. The long-sleeve undergarment and short-sleeve outer shirt can be worn together to provide substantially single layer coverage of the wearer's forearms and the wearer's torso below an imaginary line encircling the upper chest at the underarm area of the wearer. The long-sleeved partial undershirt garment accessory can be easily removed without having to remove a short-sleeve outer shirt by the wearer pulling outwardly on a first one of the long sleeves to position the arm receiving opening adjacent to their elbow, withdrawing the elbow, forearm, and hand out of the first sleeve, repeating this process for the second sleeve and arm, then gripping the central yoke portion and selectively pulling it through the outer shirt neck opening or one of its laterally opposed sleeves. The sleeved partial undershirt garment accessories may also be removed without deforming (e.g., stretching) an outer garment.

A sleeved partial undershirt garment accessory may be considered torso-less when it leaves greater than approximately 60% of the upper torso area of the body uncovered.

Any of the configurations, features, materials, shapes, etc. described herein for any of the examples, figures, garments, systems, methods may be combined with any other examples, figures, garments, systems, methods, etc. Thus, any front region in an undergarment may be combined with any back region, a hood in an undergarment may be combined with any size or shape torso opening, etc.

For example, any of the variations described herein may be worn with a dress, blouse, or other top which has a neck line which drops down in the front, in the back or both. The sleeved partial undershirt garment accessories described herein may be referred to as pullover- or jacket-style undergarment accessories for use with a sleeved or sleeveless outer-garment. The sleeved partial undershirt garment accessories described herein may extend or drops down in the front, in the back or both to cover the skin exposed by the neckline of the outer-garment, in the manner of a dickey. The front or back piece (yoke regions) could be curved upward, square, squared with rounded corners or any shape required to cover the opening above the neckline of the user. An extension in the front or back of the garment may extend downward from a neckline to the breast-line, or to the degree necessary to cover the gap left in the outer garment. In one embodiment this sleeved partial undershirt garment accessory could include a flap in the front which hangs down to about the breast-line. In an alternative embodiment the garment could be a zippered or buttoned jacket style garment that opens fully in the front, allowing it to be put on like a jacket, which may cover the arms and includes a downward extension to cover the open area of the outer-garment. Examples of these variations are illustrated in FIGS. 32-39B.

EXAMPLES

Figure 32:
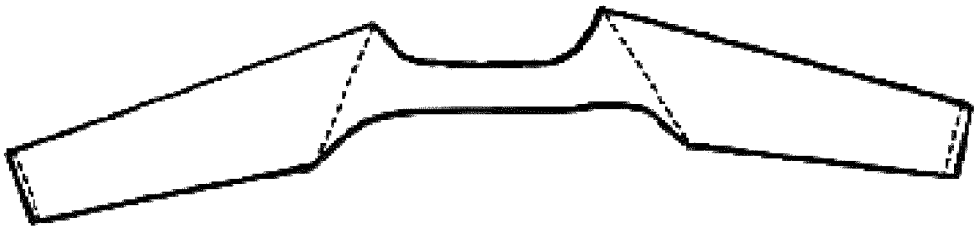
FIG. 32 shows an example of a back engaging only sleeved partial undershirt garment accessory.

FIG. 32 shows an example of a back engaging only undergarment that was manufactured from a stretchy material.

Figure 33:
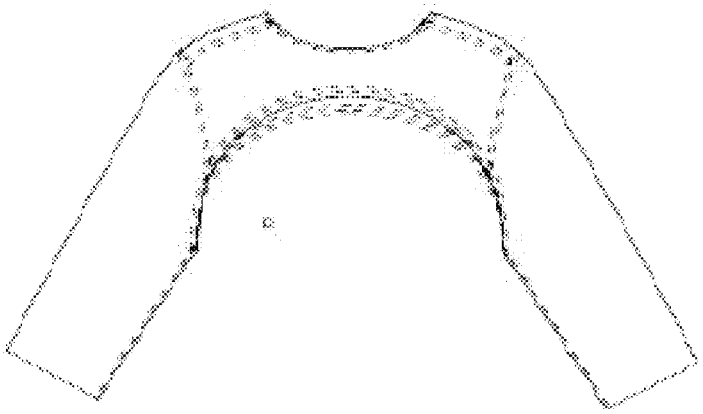
FIG. 33 shows an example of a front view of a ½ length or elbow length sleeved partial undershirt garment accessory with an arched front.

FIG. 33 shows a front view undergarment with an arched front. The undergarment was manufactured from a stretchy material.

Figure 34:
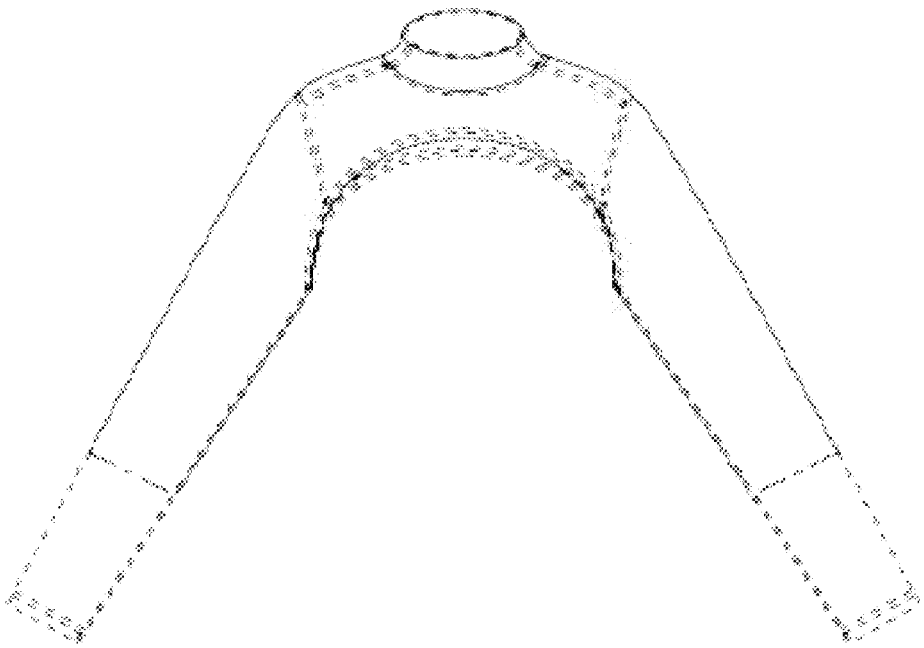
FIG. 34 shows an example of a ladies high neck sleeved partial undershirt garment accessory with a portion of the sleeves open down the length of the arm.

FIG. 34 shows a ladies high neck undergarment with a portion of the sleeves open down the length of the arm. The undergarment was manufactured from a stretchy material.

Figure 35:
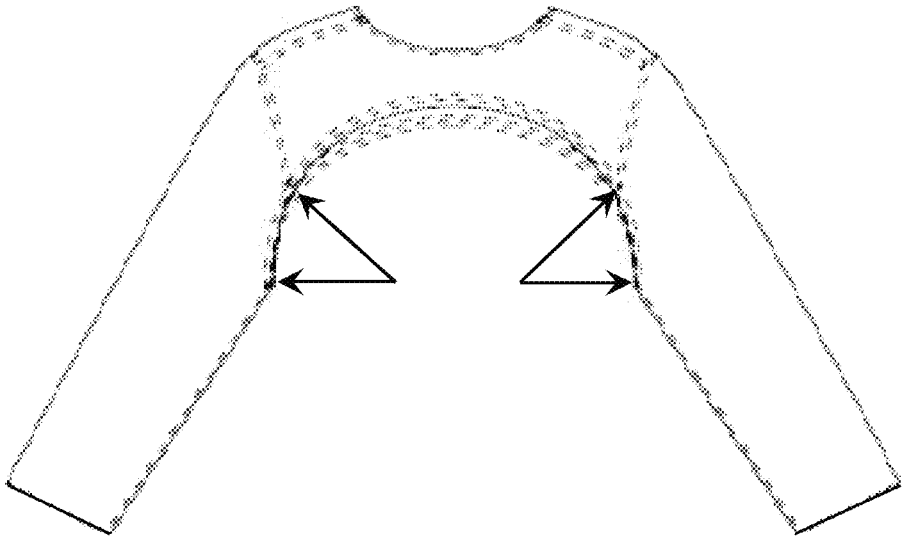
FIG. 35 shows an example of a sleeved partial undershirt garment accessory with a torso opening continuous with a sleeve opening. The extent of the shared opening is indicated by arrows.
Figure 36:
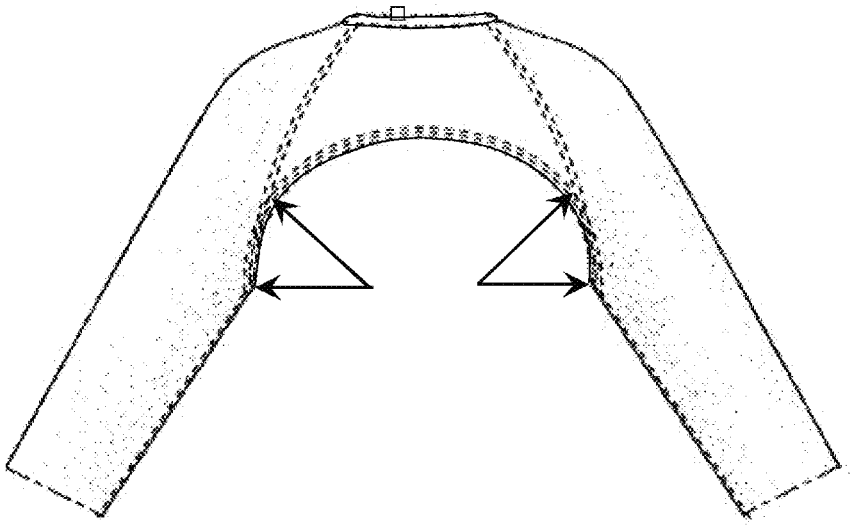
FIG. 36 shows an example of a sleeved partial undershirt garment accessory with a torso opening continuous with a sleeve opening. The extent of opening is indicated by arrows and extends partially down the sleeves.

FIG. 35 shows an example of an undershirt with a torso opening continuous with a sleeve opening. The extent of the torso opening is indicated by arrows. The undergarment was manufactured from a stretchy material FIG. 36 shows an example of an undershirt with a torso opening continuous with a sleeve opening. The extent of opening is indicated by arrows. The opening extends partially down the sleeves. The undergarment was manufactured from a stretchy material.

Figure 37:
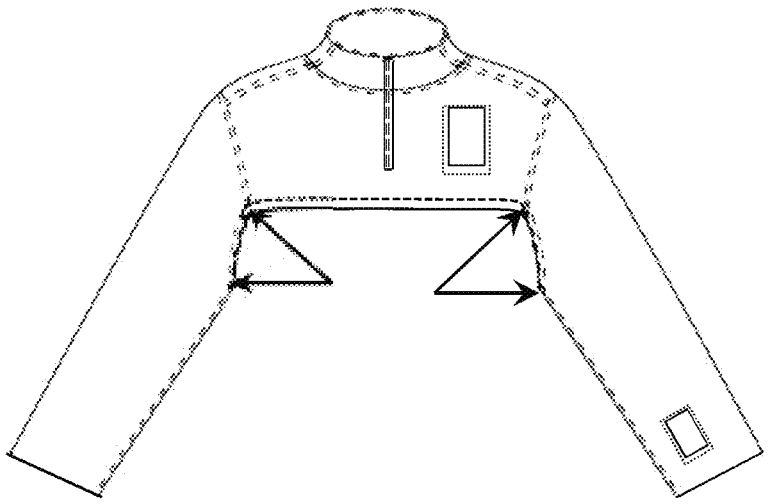
FIG. 37 shows an example of a zippered pullover sleeved partial undershirt garment accessory (including pockets) with a torso opening continuous with a sleeve opening. The extent of opening is indicated by arrows and extends partially down the sleeves.

FIG. 37 shows an example of a zippered pullover undershirt. The undergarment was manufactured from a stretchy material.

Figure 38:
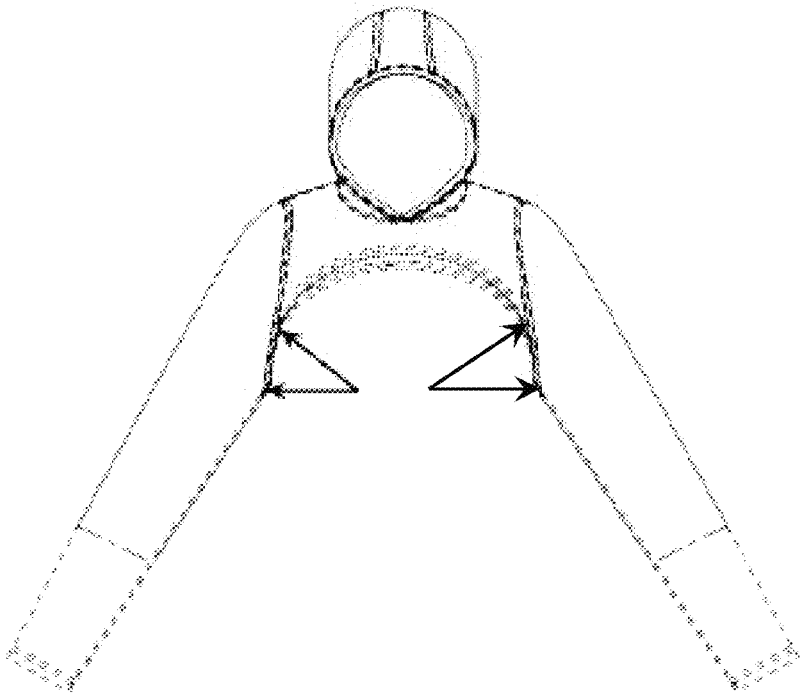
FIG. 38 shows an example of a hooded sleeved partial undershirt garment accessory. with a torso opening continuous with a sleeve opening. The extent of opening is indicated by arrows and extends partially down the sleeves.

FIG. 38 shows an example of a hooded undershirt with a closed armpit region. The undergarment was manufactured from a stretchy material.

Figure 39A:
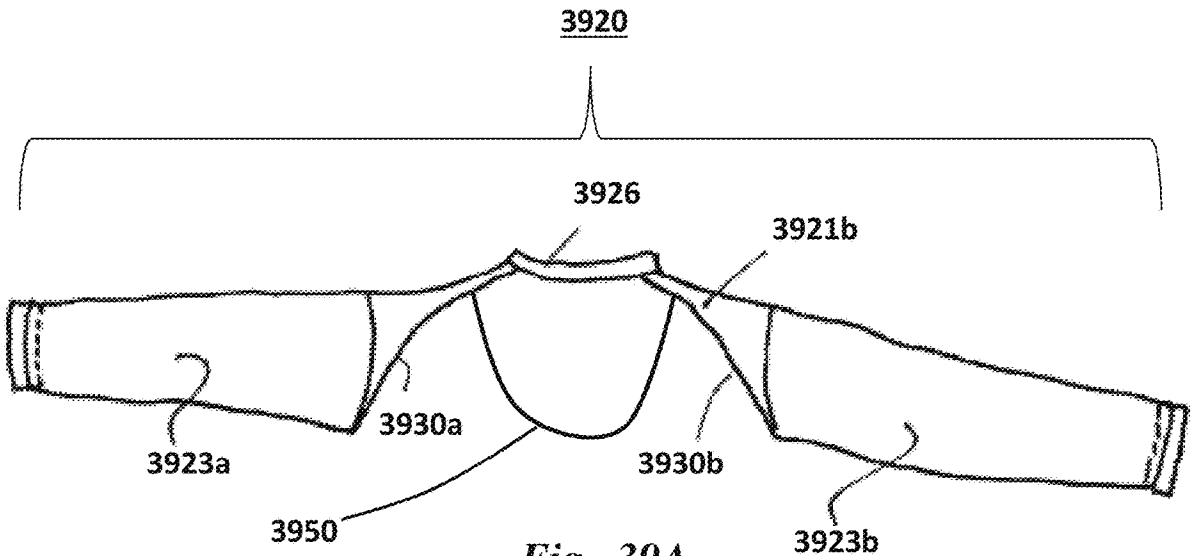
FIG. 39A shows another variation of a sleeved partial undershirt garment accessory having a bib-like region ("dickie" region) that may extend from the neck region down.
Figure 39B:
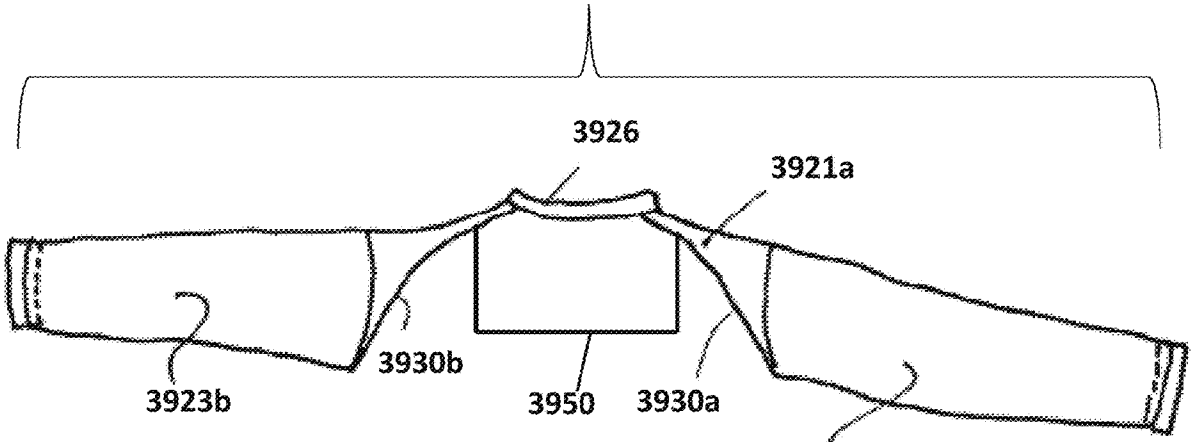
FIG. 39B is another variation of a sleeved partial undershirt garment accessory having a bib-like region.

FIG. 39A shows a garment 3920 having a pair of sleeves 3923*a*, 3923*b* connected to yoke region having a collar 3926. The back portion of the garment includes a rounded dickie region 3950 that may provide coverage when worn under an outer garment; in some variations the dickie region 3950 may be in the front portion of the garment or a dickie portion may be on both the front and back portions. FIG. 39B is similar to FIG. 39A only the dickie region 3950 is shown as rectangular or squared, rather than rounded. Embodiment such as the ones shown in FIGS. 39A-39B may be particularly useful when the garments described herein are worn with an outer garment such as a blouse or dress having a low neckline. Thus, the garments described herein may be used as part of a work (e.g., business/business casual) attire, and may be won in an office environment. The dickie component may cover the neckline when it would otherwise be exposed by an outer garment such as a dress or low cut blouse. These variations may also have utility when worn in a cold office or other locations and/or situation when it would be beneficial to provide coverage of this region of the body using devices including this "mock" (potentially free hanging) portion of the garment. Thus any of the garments described herein may include a fabric portion that hangs from the garment as a dickie or other mock-coverage region that is coupled to the garment and configured to cover the back or neck region.

Examples

The following are examples of how the garments described herein may be made or used.

Example 1: A garment system suitable for a baseball or other sports player may include an outer garment such as a jersey or uniform without a collar such as is customary to the sport. The outer garment may be as short sleeve garment with buttons in the front and made of woven material. A partial undershirt garment which is made of a light weight 2-6 oz./sq. yd. stretchable microfiber and with a sleeve length extending beyond the elbows may be a desirable combination. Alternatively, the sleeves could be ¾ or full length. The athlete could enjoy the comfort of sleeves without the added layer to the bulk of the torso area. The front or rear side for the perimeter of the torso opening may arch upward toward the neck leaving a greater area of the torso exposed. A baseball pitcher may desire to use a sleeved partial undershirt garment of a medium or higher weight material, such as a thicker 4-way stretch microfiber of 6-12 oz./sq. yd., to help retain heat in the arms and shoulders.

Example 2: In another example the outer garment may be a golf or tennis apparel, including a polo shirt with a collar. The sleeved partial undershirt may be made of a lightweight form fitting microfiber of light to medium weight (2-8 oz.) breathable fabrics of polyester, spandex or nylon blends, and designed to move with the body rather than to cling to body Example 3: A boater, hiker, or gardener may wear a conventional cotton T-shirt as an outer garment but may like to add sleeves. A partial undershirt garment of a cotton material could be worn, or alternatively a microfiber stretchable partial undershirt garment may be better suited. These users may prefer a partial sleeved undergarment which includes an ultraviolet (UV) treatment with a sun protection factor of by way of example 10, 20, 30, 50 or 100 SPF. These users may prefer a partial undershirt accessory which includes a hood.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A garment configured to provide sleeves to a user when used independently or when worn in combination with a sleeved or sleeveless outer garment, the garment comprising:

a unitary sleeved partial undershirt wherein the unitary sleeved partial undershirt includes:

tubular first and second sleeves each having a respective proximal end and a respective distal end, each having a tubular construction between its proximal and distal ends that is void of any fastener, and each having a length of at least 12 inches, wherein, when the sleeved partial undershirt is worn under the outer garment, the distal ends of the first and second sleeves extend through and beyond any first and second outer garment arm openings, respectively, such that the comfort of sleeves is provided to the user;

a yoke including a front yoke portion, a back yoke portion, an undershirt neck edge defining an undershirt neck opening, and an undershirt torso opening edge defining an undershirt torso opening, wherein:

the proximal end of each of the first and second sleeves has a proximal sleeve opening having a proximal sleeve opening top and a proximal sleeve opening bottom;

the undershirt torso opening edge extends between the proximal sleeve opening bottoms of the first and second sleeves;

the yoke extends continuously and non-separably between the first and second sleeves; and the yoke is sized such that the distance between the undershirt neck edge and the undershirt torso opening edge at the front yoke portion and at the back yoke portion is in a range between 1.35 and 8.8 inches.

2. The garment of claim 1, wherein the first and second sleeves are comprised of a stretch material adapted to provide a compressive fit to the user.

3. The garment of claim 1, wherein the unitary sleeved partial undershirt is void of any fastener.

4. The garment of claim 1, wherein the first and second sleeves are full-length sleeves.

5. The garment of claim 1, and further comprising a hood extending from the undershirt neck edge.

6. The garment of claim 1, and further comprising a zipper or buttons at the undershirt neck edge.

7. The garment of claim 1, wherein each of the first and second sleeves excludes a cuff at its distal end.

8. The garment of claim 1, wherein the yoke and first and second sleeves are comprised of a 4-way stretch material.

9. The garment of claim 1, wherein the first and second sleeves comprise compression fabric.

10. The garment of claim 1, wherein the unitary sleeved partial undershirt comprises compression fabric.

11. The garment of claim 1, wherein portions of the unitary sleeved partial undershirt around the proximal ends of the first and second sleeves comprise a material that is more stretchy than other portions of the unitary sleeved partial undershirt.

12. The garment of claim 1, wherein the first and second sleeves of the sleeved partial undershirt have a dimension across the proximal end of between 5 and 9 inches.

13. The garment of claim 1, wherein the first and second sleeves of the sleeved partial undershirt are attached to the yoke by seams.

14. The garment of claim 1, wherein the sleeved partial undershirt comprises a fabric weighing between 2 and 8 ounces per square yard.

15. The garment of claim 1, wherein the undershirt torso opening edge of the yoke extends continuously and non-separably about the undershirt torso opening between the proximal ends of the first and second sleeves and extends from the undershirt neck edge no further than the proximal sleeve opening bottoms.

16. The garment of claim 5, wherein the undershirt neck opening is a crew-style neck opening.

17. A unitary sleeved partial undershirt configured to be worn as an outer garment or for ease of wearing beneath an outer garment having first and second outer garment arm openings, wherein the unitary sleeved partial undershirt comprises:

tubular first and second sleeves each having a respective proximal end and a respective distal end, each having a tubular construction between its proximal and distal ends that is void of any fastener, and each having a length of at least 12 inches, and wherein, when the sleeved partial undershirt is worn under an outer garment, the distal ends of the first and second sleeves extend through and beyond the first and second outer garment arm openings, respectively, such that a layered garment arrangement with a sleeved base layer is provided;

a yoke including a front yoke portion, a back yoke portion, an undershirt neck edge defining an undershirt neck opening, and an undershirt torso opening edge defining an undershirt torso opening, wherein:

the proximal end of each of the first and second sleeves has a proximal sleeve opening having a proximal sleeve opening top and a proximal sleeve opening bottom;

the undershirt torso opening edge extends between the proximal sleeve opening bottoms of the first and second sleeves;

the yoke extends continuously and non-separably between the first and second sleeves; and the yoke is sized such that the distance between the undershirt neck edge and the undershirt torso opening edge at the front yoke portion and at the back yoke portion is in a range between 1.35 and 8.8 inches.

18. The unitary sleeved partial undershirt of claim 17, wherein:

the front yoke portion and back yoke portion are connected; and the yoke is sized such that the front yoke portion and the back yoke portion do not connect to each other more distal from the undershirt neck opening than distal-most points of the proximal ends of the first and second sleeves.

19. The unitary sleeved partial undershirt of claim 17, wherein at the front yoke portion, the undershirt torso opening edge curves towards the undershirt neck edge.

20. The unitary sleeved partial undershirt of claim 17, wherein the unitary sleeved partial undershirt is void of any fastener.

21. The unitary sleeved partial undershirt of claim 17, wherein the first and second sleeves are full-length sleeves.

22. The unitary sleeved partial undershirt of claim 17, wherein the undershirt torso opening extends distally along the first and second sleeves such that armpit regions of the unitary sleeved partial undershirt are reduced in area.

23. The unitary sleeved partial undershirt of claim 17, and further comprising a hood extending from the undershirt neck edge.

24. The unitary sleeved partial undershirt of claim 17, and further comprising a zipper at the undershirt neck edge.

25. The unitary sleeved partial undershirt of claim 17, wherein each of the first and second sleeves includes a cuff at its distal end.

26. The unitary sleeved partial undershirt of claim 17, wherein the unitary sleeved partial undershirt comprises at least one of a stretch material, a microfiber material, a mesh, and a 4-way stretch material.

27. The unitary sleeved partial undershirt of claim 17, wherein the unitary sleeved partial undershirt is sized to provide a compression fit.

28. The unitary sleeved partial undershirt of claim 17, wherein portions of the unitary sleeved partial undershirt around the proximal ends of the first and second sleeves comprise a material that is more stretchy than other portions of the unitary sleeved partial undershirt.

29. The unitary sleeved partial undershirt of claim 17, wherein the first and second sleeves of the sleeved partial undershirt have a dimension across the proximal end of between 5 and 9 inches.

30. The unitary sleeved partial undershirt of claim 17, wherein the first and second sleeves of the sleeved partial undershirt are attached to the yoke by seams.

31. The unitary sleeved partial undershirt of claim 17, wherein the sleeved partial undershirt comprises a fabric weighing between 2 and 8 ounces per square yard.

32. The unitary sleeved partial undershirt of claim 17, wherein the undershirt neck opening is a crew-style neck opening.

33. A hooded sleeved partial undershirt configured to be worn as an outer garment or for ease of wearing beneath an outer garment having first and second outer garment arm openings, wherein the unitary sleeved partial undershirt comprises:

tubular first and second sleeves each having a respective proximal end and a respective distal end, each having a tubular construction between its proximal and distal ends and each having a length of at least 12 inches, wherein, when the sleeved partial undershirt is worn under an outer garment, the distal ends of the first and second sleeves extend through and beyond the first and second outer garment arm openings, respectively, such that a hooded layered garment arrangement with a sleeved base layer is provided;

a yoke including a front yoke portion, a back yoke portion, an undershirt neck edge defining an undershirt neck opening, and an undershirt torso opening edge defining an undershirt torso opening, wherein:

the yoke extends continuously and non-separably between the first and second sleeves;

the proximal end of each of the first and second sleeves has a proximal sleeve opening having a proximal sleeve opening top and a proximal sleeve opening bottom;

the undershirt torso opening edge extends between the proximal sleeve opening bottoms of the first and second sleeves;

the yoke is sized such that the distance between the undershirt neck edge and the undershirt torso opening edge at the front yoke portion and back yoke portion is in a range between 1.35 and 8.8 inches; and a hood coupled to the yoke.

34. The hooded sleeved partial undershirt of claim 33, wherein the first and second sleeves are comprised of a stretch material adapted to provide a compressive fit to the user.

35. The hooded sleeved partial undershirt of claim 33, wherein the hooded sleeved partial undershirt is void of any fastener.

36. The hooded sleeved partial undershirt of claim 33, wherein the first and second sleeves are full-length sleeves.

37. The hooded sleeved partial undershirt of claim 33, and further comprising a zipper or buttons at the undershirt neck edge.

38. The hooded sleeved partial undershirt of claim 33, wherein each of the first and second sleeves excludes a cuff at its distal end.

39. The hooded sleeved partial undershirt of claim 33, wherein the yoke and first and second sleeves are comprised of a 4-way stretch material.

40. The hooded sleeved partial undershirt of claim 33, wherein at least the first and second sleeves comprise compression fabric.

41. The hooded sleeved partial undershirt of claim 33, wherein portions of the hooded sleeved partial undershirt around the proximal ends of the first and second sleeves comprise a material that is more stretchy than other portions of the hooded sleeved partial undershirt.

42. The hooded sleeved partial undershirt of claim 33, wherein the first and second sleeves have a dimension across the proximal end of between 5 and 9 inches.

43. The hooded sleeved partial undershirt of claim 33, wherein the first and second sleeves are attached to the yoke by seams.

44. The hooded sleeved partial undershirt of claim 33, wherein the sleeved partial undershirt comprises a fabric weighing between 2 and 8 ounces per square yard.

45. The hooded sleeved partial undershirt of claim 33, wherein the undershirt torso opening edge of the yoke extends continuously and non-separably about the undershirt torso opening between the proximal ends of the first and second sleeves and extends from the undershirt neck edge no further than the proximal sleeve opening bottoms.

46. The hooded sleeved partial undershirt of claim 33, wherein the undershirt neck opening is a crew-style neck opening.

* * * * *